US007165624B1

(12) United States Patent
Fischer

(10) Patent No.: US 7,165,624 B1
(45) Date of Patent: Jan. 23, 2007

(54) EARLY SUPPRESSION FAST RESPONSE FIRE PROTECTION SPRINKLER

(75) Inventor: Michael A. Fischer, West Kingston, RI (US)

(73) Assignee: Grinnell Corporation, Westminster, MA (US)

( * ) Notice: Subject to any disclaimer, the term of this patent is extended or adjusted under 35 U.S.C. 154(b) by 0 days.

(21) Appl. No.: 09/292,152

(22) Filed: Apr. 15, 1999

Related U.S. Application Data

(63) Continuation-in-part of application No. 09/134,493, filed on Aug. 14, 1998, now Pat. No. 6,059,044, and a continuation-in-part of application No. 09/079,789, filed on May 15, 1998, now abandoned.

(51) Int. Cl.
*A62C 37/08* (2006.01)

(52) U.S. Cl. ..... 169/37; 169/16; 169/39; 169/46; 239/518; 239/498

(58) Field of Classification Search ..... 239/208, 239/209, 504, 524, 525, 501, 502, 506, 518, 239/522, 498; 169/39–41, 16, 46
See application file for complete search history.

(56) References Cited

U.S. PATENT DOCUMENTS

| | | | | |
|---|---|---|---|---|
| 720,013 A | | 2/1903 | Esty | |
| 824,128 A | * | 6/1906 | Martin | 169/39 |
| 1,165,313 A | * | 12/1915 | Bower | 169/39 |
| 2,862,565 A | | 12/1958 | Dukes | |
| 3,525,402 A | | 8/1970 | Hattori | |
| 3,653,444 A | | 4/1972 | Livingston | |
| 3,682,251 A | | 8/1972 | Livingston | |

(Continued)

FOREIGN PATENT DOCUMENTS

WO WO 98/18525 5/1998

OTHER PUBLICATIONS

Underwriters Laboratory Inc. for Grinnell Corporation, Fire Test Data Summary for Model ESFR–25 Sprinkler, Sep. 30, 1998.*
National Fire Protection Association. NFPA 13—Standard for the Installation of Sprinkler Systems (1996 edition), pp 13–1 through 13–148.
National Fire Protection Association. NFPA 231—Standard for General Storage (1998 edition), pp. 231–1 through 231–31.
National Fire Protection Association. NFPA 231C—Standard for Rack Storage of Materials (1998 edition), pp. 231C–1 through 231C–75.
Search Report under Section 17, issued by GB Patent Office for corresponding GB Patent Application No. 9911294.8 (dated Aug. 24, 1999).

(Continued)

*Primary Examiner*—Dinh Q. Nguyen
(74) *Attorney, Agent, or Firm*—Montgomery W. Smith; David Laub

(57) ABSTRACT

An early suppression fast response pendent-type fire protection sprinkler is suitable for use in accordance with one or more of NFPA 13, NFPA 231 and NFPA 231C to protect single row rack storage, double row rack storage and multiple row rack storage, the sprinkler having a K-factor of about 25 and flowing pressure of about 15 pounds per square inch. Preferably, the sprinkler has a body defining an orifice and an outlet for delivering a flow of fluid from a source, and a deflector mounted with a first surface opposed to flow of fluid from the outlet. The deflector defines at least one pair of generally opposed reentrant slots extending from the first surface through the deflector, the reentrant slots extending from slot openings at an outer peripheral edge of the deflector inwardly from the peripheral edge toward a deflector axis.

89 Claims, 9 Drawing Sheets

U.S. PATENT DOCUMENTS

| | | | | | |
|---|---|---|---|---|---|
| 3,722,596 | A | | 3/1973 | Livingston | |
| 3,743,022 | A | * | 7/1973 | Livingston | 169/37 |
| 3,768,736 | A | | 10/1973 | Cox | |
| 3,812,915 | A | | 5/1974 | Livingston | |
| 3,888,313 | A | | 6/1975 | Freeman | |
| 3,904,126 | A | | 9/1975 | Allard | |
| 4,091,873 | A | | 5/1978 | Werner | |
| 4,099,675 | A | | 7/1978 | Wohler et al. | |
| 4,136,740 | A | | 1/1979 | Groos et al. | |
| 4,279,309 | A | | 7/1981 | Fischer et al. | |
| 4,296,815 | A | | 10/1981 | Mears | |
| 4,296,816 | A | | 10/1981 | Fischer | |
| 4,405,018 | A | | 9/1983 | Fischer | |
| 4,580,729 | A | | 4/1986 | Pounder | |
| 4,657,085 | A | | 4/1987 | Jacobsen | |
| 4,800,961 | A | | 1/1989 | Klein | |
| 4,901,799 | A | | 2/1990 | Pepi et al. | |
| 4,930,578 | A | | 6/1990 | Barnett et al. | |
| 5,036,923 | A | | 8/1991 | Shea | |
| 5,094,298 | A | | 3/1992 | Polan | |
| 5,152,344 | A | | 10/1992 | Fischer et al. | |
| 5,366,022 | A | * | 11/1994 | Meyer et al. | 169/37 |
| 5,579,846 | A | | 12/1996 | Meyer et al. | |
| 5,584,344 | A | | 12/1996 | Meyer et al. | |
| 5,609,211 | A | | 3/1997 | Meyer et al. | |
| 5,664,630 | A | | 9/1997 | Meyer et al. | |
| 5,687,914 | A | | 11/1997 | Bosio et al. | 239/498 |
| 5,829,532 | A | | 11/1998 | Meyer et al. | |
| 5,839,667 | A | | 11/1998 | Fishcer | 169/37 |
| 5,862,994 | A | | 1/1999 | Pounder et al. | 239/498 |
| 5,865,256 | A | | 2/1999 | Pounder | 169/37 |
| 5,890,657 | A | | 4/1999 | Ponte | 239/498 |
| 5,915,479 | A | | 6/1999 | Ponte | 169/46 |
| 6,059,044 | A | * | 5/2000 | Fischer | 169/37 |
| 6,502,643 | B1 | * | 1/2003 | Meyer et al. | 169/37 |

OTHER PUBLICATIONS

Underwriters Laboratories Inc., UL 1767, "Standard for Safety, Early–Suppression Fast–Response Sprinklers", First Edition, Feb. 1990.

Factory Mutual Engineering Corp., "Loss Prevention Data 2–2, Early Suppression Fast Responses Sprinklers", Apr. 1987.

Factory Mutual Research, "Approval Standard, Early Suppression Fast Response Automatic Sprinklers", Jun. 1986.

"Automatic" Sprinkler Corporation of America product sheets entitled "Automatic ESFR Glass Bulb Sprinkler", Feb. 1988 (pp. J 5.3, J 5.4).

ASCOA First Systems data sheets entitled "Automatic ESFR Glass Bulb Sprinkler", Mar. 1992 (pp. 1.1, 1.2).

Grinnell Corporation data sheets entitled "Early Suppression Fast Response Sprinklers/Model ESFR–1 Pendent, 14.3 K–Factor", Apr. 1988.

Reliable Automatic Sprinkler product anouncement, "ESFR Model H Early Suppression Fast Response Sprinkers", Oct. 1992 (3 pp. total).

Central Sprinkler Company catalog sheets entitled "Central ESFR–1 3–93/ESFR Early Suppression Fast Response", Mar. 1993 (4 pp).

Drawing entitled, "International Jumbo Sprinkler Head—Deflector", DWG. No. 1–117, Automatic Sprinkler Co. of America, Mar. 1926 (1 pg).

Sheet entitled "Grinnell Jumbo Sprinkler Issue A", Grinnell Corp., Feb. 1969 (1 pg).

Drawing entitled "Solder–Type—Issue A 1/14" Grinnell Jumbo Sprinkler Yoke, Body, Strut, Diaphragm and Disc", General Fire Extinguisher Company, Apr. 1917 (1 pg).

Drawing entitled "1" Grinnell Jumbo Sprinkler Detail Solder Type Issue 'A", General Fire Extinguisher Co., Apr. 1917 (1 pg).

NJ Thompson, Fire Behavior and Sprinklers, Chapter 6 "Automatic Sprinkler Protection", National Fire Protection Association, 1964, Foreward, Table of Contents (pp. 72–91).

Newsletter for Fire Protection Engineers and Industry, No. 11, Jul. 1968, Orinda, California (8 pp).

D.G. Goodfellow et al., Technical Report entitled "Optimization of Sprinkler Protection for United States Postal Service III. Protection of Plastic Letter Trays", Factory Mutual Research Corp., Oct. 1971 (39 pp).

D.G. Goodfellow, Technical Report entitled Optimization of Sprinkler Protection for United States Postal Facilities/IV Protection of Plastic Letter Trays with 0.64—in. Retrofit Sprinklers, Factory Mutual Research Corporation, Jul. 1974 (30 pp. with cover and introductory pages).

E.W.J. Troup, Technical Report entitled "New Developments in Ceiling—Level Protection for the High–Challenge Fire", Factory Mutual Research Corporation, Jan. 1974.

P.J. Chicarello et al., Technical Report entitled "Large–Scale Fire Test Evaluation of Early Suppression Fast Response (ESFR) Automatic Sprinklers",Factory Mutual Research Corp., May 1986 (cover–p. 18–pp. 122–128).

C. Yao, "The Development of the ESFR Sprinkler System", First Safety Journal, Elsevier Scientific Ltd., Kidlington, Oxford, U.K., 1988, vol. 14, No. 11 (pp. 65–73).

C. Yao, "Overview of FMRC's Sprinkler Technology Research", Factory Mutual Research Corporation, May 1992.

Approved Product News, Factory Mutual Engineering Corp., vol. 4, No. 2, Dec. 1988 (pp. 1–5, 8–12, 16).

Fire Protection Handbook, 17th Edition, National Fire Protection Association, 1991, Title page, inner page, Table of Contents, p. IX and pp. 5–127 through 5–163 and 5–174 through 5–197).

K. Bell, "Presentation to American Fire Sprinkler Association—Large K–Factor Sprinklers", Nov. 1992 (59 pp. total: 19 pp. text and 40 pp. slide photocopies).

Color photocopies of six color photographs of sprinkler case with "I.S. Co." on deflector and PAT.03 on the body and 1903 stamped on the release link (labeled Jun. 1995) (2 pp.).

Color photocopies of six color photographs of sprinkler case with "Globe" and 280 on body, G A S Co. on deflector and stamped 1926 on release ink (labeled Jun. 1995) (2 pp.).

Color photocopies of five color photographs of Grinnell Corporation "Jumbo A" automatic sprinkler—1 1/4" orifice, (labeled Jun. 1995) (2 pp.).

Color photocopies of five color photographs of Grinnell Corporation, "Jumbo A" automatic sprinkler—1" orifice, (labeled Jun. 1995) (2 pp.) (body pained red).

* cited by examiner

EARLY SUPPRESSION FAST RESPONSE FIRE PROTECTION SPRINKLER

CROSS REFERENCE TO RELATED APPLICATIONS

This application is a continuation-in-part of U.S. patent application Ser. No. 09/134,493, filed Aug. 14, 1998, which is now U.S. Pat. No. 6,059,044, and a continuation-in-part of U.S. patent application Ser. No. 09/079,789, filed May 15, 1998, which is abandoned.

BACKGROUND OF THE INVENTION

Fire protection sprinklers may be operated individually, e.g. by a self-contained thermally sensitive element, or as part of a deluge system in which fire retardant fluid flows through a number of open sprinklers, essentially simultaneously. Fire retardant fluids may include natural water or appropriate mixtures of natural water and one or more additives to enhance fire fighting properties of a fire protection system.

Fire protection sprinklers generally include a body with an outlet, an inlet connectable to a source of fire retardant fluid under pressure, and a deflector supported by the body in a position opposing the outlet for distribution of the fire retardant fluid over a predetermined area to be protected from fire. Individual fire protection sprinklers may be automatically or non-automatically operating. In the case of automatically operating fire protection sprinklers, the outlet is typically secured in the normally closed or sealed position by a cap. The cap is held in place by a thermally-sensitive element which is released when its temperature is elevated to within a prescribed range, e.g. by the heat from a fire. The outlets of non-automatic sprinklers are maintained normally open, and such sprinklers are operated in an array, as part of a deluge system, from which fire retardant fluid flows when an automatic fluid control valve is activated by a separate fire, e.g. heat, detection system.

Installation or mounting position is another parameter which distinguishes different types of fire protection sprinklers. For example: Pounder U.S. Pat. No. 4,580,729 illustrates a pendent mounting (i.e., pendent-type) sprinkler arranged so that the fluid stream discharged from the outlet is directed initially downwards against the deflector; Dukes U.S. Pat. No. 2,862,565 illustrates an upright mounting (i.e., upright-type) sprinkler arranged so that the fluid stream discharged from the outlet is directed initially upwards against the deflector; and Mears U.S. Pat. No. 4,296,815 and Fischer U.S. Pat. No. 4,296,816 illustrate a horizontal mounting (i.e., horizontal-type) sprinkler arranged so that the fluid stream discharged from the outlet is directed initially horizontally against the deflector. In each case, the purpose of the deflector is to break up the fluid stream into a pattern of spray that can suitably cover the area to be protected by the sprinkler from fire.

ESFR (Early Suppression Fast Response) fire protection sprinkler applications have typically required the use of pendent sprinklers. Upright and horizontal sprinklers have generally been found less suitable for ESFR applications, particularly at commodity storage heights of greater than 30 feet. This is because upright sprinklers inherently have reduced downward spray directly beneath the sprinklers and, therefore, underneath the fire protection fluid supply piping from which they are fed. Horizontal type sprinklers, on the other hand, are generally designed with a spray pattern that projects horizontally to protect more remote reaches of the intended coverage area and, as such, do not provide the downward thrust of fluid spray necessary for ESFR sprinkler applications, over the entire area to be protected from fire by the sprinkler.

The concept underlying ESFR sprinkler technology is that of delivering onto a fire at an early stage a quantity of water sufficient to suppress the fire before a severe challenge can develop. ESFR sprinklers are particularly useful in commercial settings where the clearance between the sprinklers and the source of the fire could be large. For example, in a warehouse having high ceilings, the distance between pendent sprinklers and the upper surfaces of combustible commodities in the storage racks can be relatively large. In such settings, the size of a fire can grow significantly before a first sprinkler is activated by heat from the fire. Thus, it was recognized that to suppress a fire in such a setting, a greater quantity of water should be delivered quickly so that the fire will be kept less intense, and the corresponding convective heat release rate will be kept lower. In turn, with a lower heat release rate, the upward plume velocity of the fire will also be relatively lower. Fire protection specialists often characterize this concept by saying that the Actual Delivered Density (ADD) of the first operating sprinkler(s) should exceed the Required Delivered Density (RDD). RDD is defined as the actual density of fire retardant fluid required to suppress a fire in a particular combustible commodity in units of $gpm/ft^2$. ADD is generally defined as the density at which water is actually deposited from operating sprinklers onto the top horizontal surface of a burning combustible array, in units of $gpm/ft^2$.

The relationships between sprinkler spray patterns, fire plume velocity, and amount of combustible commodity are important factors which need to be taken into account in the design of ESFR sprinklers. As the ceiling-to-floor distance increases and the amount of combustible commodity increases, the fire plume velocity and upward thrust increase to such vigorous levels that standardized tests now require actual opposing thrust specifications in the central area of the spray pattern for certification of an automatic fire protection sprinkler for service in the ESFR sprinkler category (Ref. Underwriters Laboratories (UL) and Factory Mutual (FM) ESFR Sprinkler Standards). Previous approaches for addressing higher elevation, higher challenge fire protection applications with ESFR pendent sprinklers have included using deflectors with straight slots or slots that taper to become slightly wider in the radially outward direction, in combination with increasing fluid water pressure to compensate for increased elevations, since the thrust of the spray pattern is a combination of both velocity and mass of the fire retardant fluid droplets.

ESFR pendent sprinklers often provide a sprinkler spray pattern having a central downward thrusting core formation. Providing a central core of high thrust droplets is particularly important in higher elevation, higher challenge fire protection applications where the updraft of a quickly developing fire located under a sprinkler head could fully displace the spray pattern of the sprinkler head if the downward thrust was insufficient to effectively oppose the updraft. One approach for providing more water coaxial with the centerline of the sprinkler spray pattern is described in Mears U.S. Pat. No. 4,296,815, the entire disclosure of which is incorporated herein by reference. Mears '815 describes a horizontal sidewall sprinkler with a discharge which increases the amount of fire protection fluid in the region coaxial with the sprinkler discharge axis by use of a deflector with radially extending tines spaced by reentrant slots. A reentrant slot is defined as a cutout extending through a deflector and generally radially inwardly from an opening at the deflector periphery, the slot having a transverse width which is larger at a more radially inward portion of the deflector than the transverse width nearer the peripheral region of the deflector.

SUMMARY OF THE INVENTION

The invention relates to pendent-type fire protection sprinklers of the type including a sprinkler body defining an orifice and an outlet for delivering a flow of fluid from a source, and at least one arm extending from the sprinkler body. The orifice defines an orifice axis, and the outlet is disposed generally coaxial with the orifice axis. The sprinkler also includes an apex element supported by the arm, with an apex axis generally coaxial with the orifice axis, and a deflector mounted to the apex element at a distance further from the outlet than the apex element.

In a general aspect of the invention, the deflector includes a deflector body defining a first, inside surface opposed to the flow of fluid, an opposite, second surface, and a deflector axis generally coaxial with the orifice axis. The deflector body defines two or more generally opposing reentrant slots extending through the deflector body, from the first, inside surface to the second, outside surface, with the slot openings at an outer peripheral edge of the deflector body. The reentrant slots extend inwardly from the peripheral edge, each along a reentrant slot centerline or axis, generally toward the deflector axis. Each reentrant slot also has a first width measured transverse to the slot centerline in a region of the peripheral edge and a second width measured transverse to the slot centerline at a regions spaced inwardly, toward the deflector axis, relative to the region of the peripheral edge, the second width being greater than the first width. The innermost portion of each reentrant slot extends inwardly toward the deflector axis so as to be no further outward from the deflector axis than the outermost surface of the apex element.

The portion of the deflector between the slots extending inward from the periphery of the deflector and the larger width opening at the radially more inward portion of the deflector provides a web-like component spray pattern extending outward from the central core formation.

Pendent-type fire protection sprinklers of the invention are fixed deflector, impingement-type fire protection sprinklers in which the body defines an inlet for connection to a source of fluid under pressure, an outlet, and an orifice normally located just upstream of the outlet. The outlet may be normally closed by a plug held in place by a thermally responsive element configured to automatically release the plug when the temperature of the thermally responsive element is elevated to within a prescribed range. Upon operation (i.e., release of the plug), whether the fire protection sprinkler is individually operated or used open as part of a local application or total flooding system, a vertically directed, relatively coherent, single stream of water (downward for pendent-type sprinklers) rushes through the outlet, from the orifice, towards the deflector. As it impacts (i.e., impinges) upon the deflector, the water is diverted generally radially downward and outward, breaking up into a spray pattern, the configuration of which, in large part, is a function of the deflector design, and it is projected over the intended area of coverage, i.e., the protected area.

The flow rate "Q" from a sprinkler in which a single stream of water is discharged from the outlet orifice, expressed in U.S. gallons per minute (gpm), is determined by the formula:

$$Q=K(p)^{1/2}$$

where: "K" represents the nominal nozzle discharge coefficient (normally referred to as K-factor), and "p" represents the residual (flowing) pressure at the inlet to the nozzle in pounds per square inch (psi).

Fire protection sprinklers of the invention operate by impacting a relatively coherent, single fluid jet against the deflector described above. The sprinkler has a K-factor preferably in a range of from about 8.0 to 50.0, more preferably in the range of about 14.0 to about 30.0, and most preferably about 25.0, the range from about 14.0 to 30.0 being found more preferable from the standpoint of minimizing fire protection system installation costs and operating power requirements.

Larger K-factors have been determined to be capable of delivering quantities of fire retardant fluid sufficient for an ESFR sprinkler application. As the elevation of the particular hazard increases (i.e., taller warehousing), the pressure required to deliver quantities of fluid sufficient to produce the downward thrust necessary to oppose well developed fire updrafts from such elevations becomes so high as to be impractical when K-factors are less than about 8.0. However, for K-factors of about 14.0 or greater, and at the required delivered rate of fire retardant fluids, a sprinkler pressure sufficient to produce the required downward thrust by traditional deflector means is practical to achieve, but may not be as economical as desired.

In preferred embodiments, the deflector compensates for the lower droplet velocities at the lower inlet pressures desirable for the larger K-factor sprinklers by diverting an optimized portion of the spray selectively directed within the spray pattern. The deflector is provided with at least one set of reentrant slots positioned so that their most radially inward portion is no further outward from the deflector axis than the outermost surface of the apex element of the sprinkler frame. With this arrangement, there is diverted a quantity of fire retardant fluid sufficient to produce the required amount of thrust in the inner, downwardly-directed portion of the spray pattern at pressures lower than those produced by either straight slots or slots that taper to become slightly wider in the radially outward direction.

According to the invention, an early suppression fast response pendent-type fire protection sprinkler suitable for use in accordance with one or more of NFPA 13, NFPA 231 and NFPA 231C to protect single row rack storage, double row rack storage and multiple row rack storage has a K-factor of about 25 and a flowing pressure of about 15 pounds per square inch.

Preferred embodiments of the invention may have one or more of the following additional features. The sprinkler further comprises a sprinkler body defining an orifice and an outlet for delivering a flow of fluid from a source, and a deflector mounted with a first surface opposed to flow of fluid from the outlet, the deflector defining at least two reentrant slots disposed in opposition about a deflector axis, the reentrant slots extending from the first surface through the deflector, and the reentrant slots extending from slot openings at an outer peripheral edge of the deflector inwardly from the peripheral edge toward the deflector axis. Preferably, the reentrant slots extend inwardly along reentrant slot centerlines, and each of the reentrant slots has a first width transverse to its reentrant slot centerline in a region of the peripheral edge and a second slot width transverse to its reentrant slot centerline in a region spaced inwardly, toward the deflector axis, relative to the region of the peripheral edge, the second width being greater than the first width. More preferably, the sprinkler further comprises an apex element, the deflector is mounted to the apex element, and an innermost portion of each of the reentrant slots extends inwardly toward the deflector axis to be no further outward from the deflector axis than an outermost surface of the apex element, and, preferably, the innermost portions of the reentrant slots extend inwardly toward the deflector axis to underlie the apex element, relative to fluid flow direction from the outlet. The reentrant slot centerlines extend radially outward from the deflector axis. The sprinkler is suited for installation up to 18 inches below a ceiling. The deflector has a thickness measured from the first surface in the direction of fluid flow equal to or greater than about 0.06 inch. The reentrant slots comprise a plurality of reentrant slots comprising at least a first type of reentrant slot and a second type of reentrant slot, reentrant slots of the first type extending from the first surface through the deflector with the slot openings at an outer peripheral edge of the deflector body, each of the reentrant slots of the first type extending inwardly from the peripheral edge, along the reentrant slot centerlines, generally toward the deflector axis, to a first type length, reentrant slots of the second type extending through the deflector from the first surface, with the slot openings at the peripheral edge of the deflector body, each of the reentrant slots of the second type extending inwardly from the peripheral edge, along the reentrant slot centerlines, generally toward the deflector axis, to a second type length, and the innermost portions of the reentrant slots of the first type extending inwardly toward the deflector axis to be no further outward from the deflector axis than the outermost surface of the apex element. Preferably, each of the reentrant slots of the first type has a first width transverse to its slot centerline in a region of the peripheral edge and a second width transverse to its slot centerline in a region spaced inwardly, toward the deflector axis, relative to the region of the peripheral edge, the second width of the first type slots being greater than the first width of the first type slots, and each of the reentrant slots of the second type has a first width transverse to the slot centerline in a region of the peripheral edge and a second width transverse to the slot centerline in a region spaced inwardly, toward the deflector axis, relative to the region of the peripheral edge, the second width of the second type slots being greater than the first width of the second type slots. The first type length is equal to or greater than the second type length. The reentrant slot centerlines of the reentrant slots of the first type extend substantially radially outward from the deflector axis. The reentrant slot centerlines of the reentrant slots of the second type extend substantially radially outward from the deflector axis. The reentrant slots of the first type comprise at least two pairs of generally opposing reentrant slots. The reentrant slots of the second type comprise at least two pairs of generally opposing reentrant slots. The first type length of the reentrant slots of the first type is substantially the same. The second type length of the reentrant slots of the second type is substantially the same. The reentrant slots of the first type define reentrant portions having an elongated shape. The reentrant slots of the second type define reentrant portions having a pear-shape. A reentrant slot of the second type is located between reentrant slots of the first type.

In another aspect of the invention, the deflector body defines reentrant slots including first and second types of reentrant slots, with each type including two or more reentrant slots. At least two, generally opposing reentrant slots of the first type of reentrant slots extend through the deflector body, from the first, inside surface to the second, outside surface, each with the slot opening at an outer peripheral edge of the deflector body and extending inwardly from the peripheral edge, along its reentrant slot centerline, generally toward the deflector axis, to a first type slot length. The reentrant slots of the first type have a first width measured transverse to the slot centerline in a region of the peripheral edge and a second width measured transverse to the slot centerline in a region spaced inwardly, toward the deflector axis, relative to the region of the peripheral edge, the second width being greater than the first width. At least two generally opposing reentrant slots of the second type of reentrant slots also extend through the deflector body, from the first, inside surface to the second, outside surface, with a slot opening at an outer peripheral edge of the deflector body, and extend inwardly from the peripheral edge, along its reentrant slot centerline, generally toward the deflector axis, to a second type slot length. The reentrant slots of the second type have a first width measured transverse to the slot centerline in a region of the peripheral edge and a second width measured transverse to the slot centerline in a region spaced inwardly, toward the deflector axis, relative to the region of the peripheral edge, the second width being greater than the first width. Each of the reentrant slots of the first type is disposed between reentrant slots of the second type, with the first type slot lengths being different from the second type slot lengths.

With this arrangement, the use of alternating pairs of generally opposing reentrant slots of the second type provides an intermediate componentized spray pattern. The intermediate componentized spray pattern is particularly effective in ESFR sprinkler applications where updrafts in regions between the outer shell regions and regions along the central axis of the sprinkler orifice are created. Such updrafts are often created in higher elevation, higher challenge settings (e.g., warehouses) where the increased elevation allows a fire to grow to a large size before operating a sprinkler head positioned off center from the ignition point of the fire.

These and other features and advantages of the invention will be apparent from the following more detailed description, and from the claims.

DESCRIPTION OF THE PREFERRED EMBODIMENTS

Figure 1:
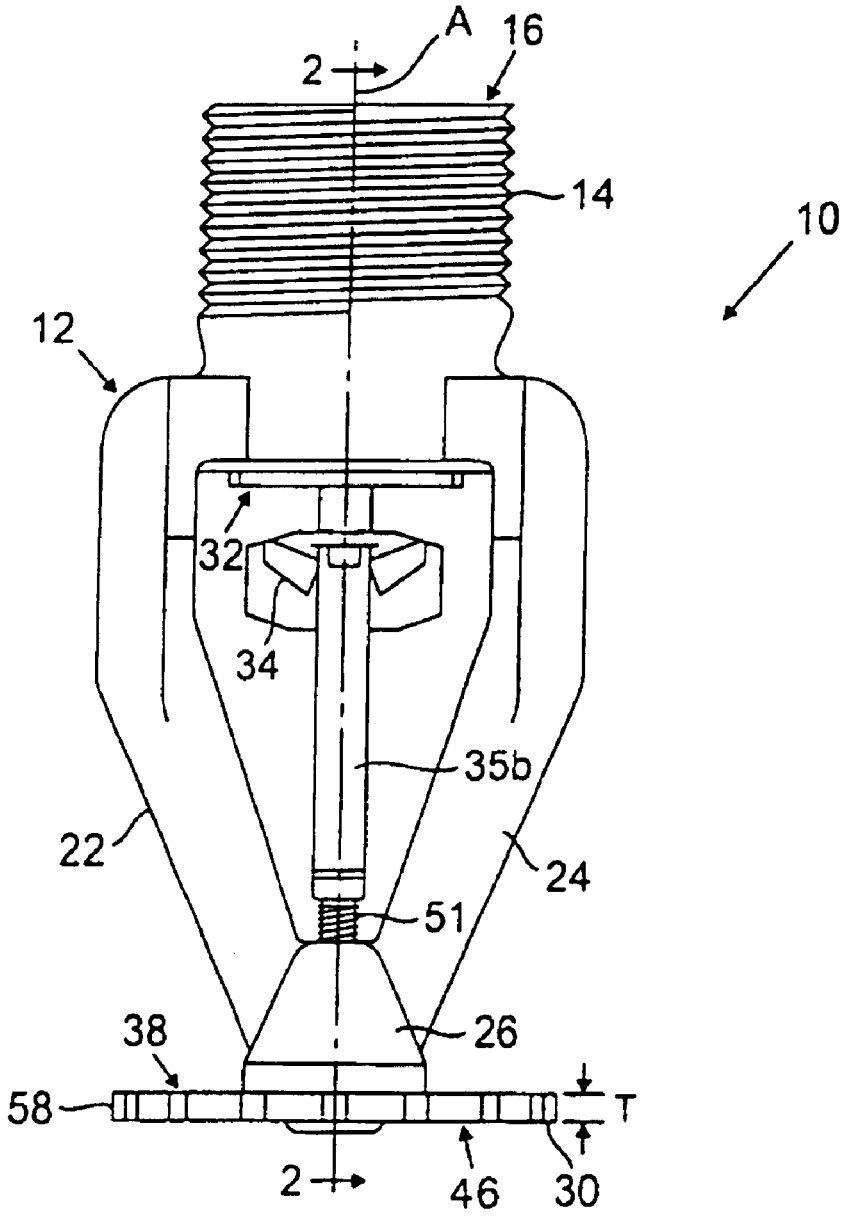
FIG. 1 is a side elevational view of a fire protection sprinkler of the invention.
Figure 2:
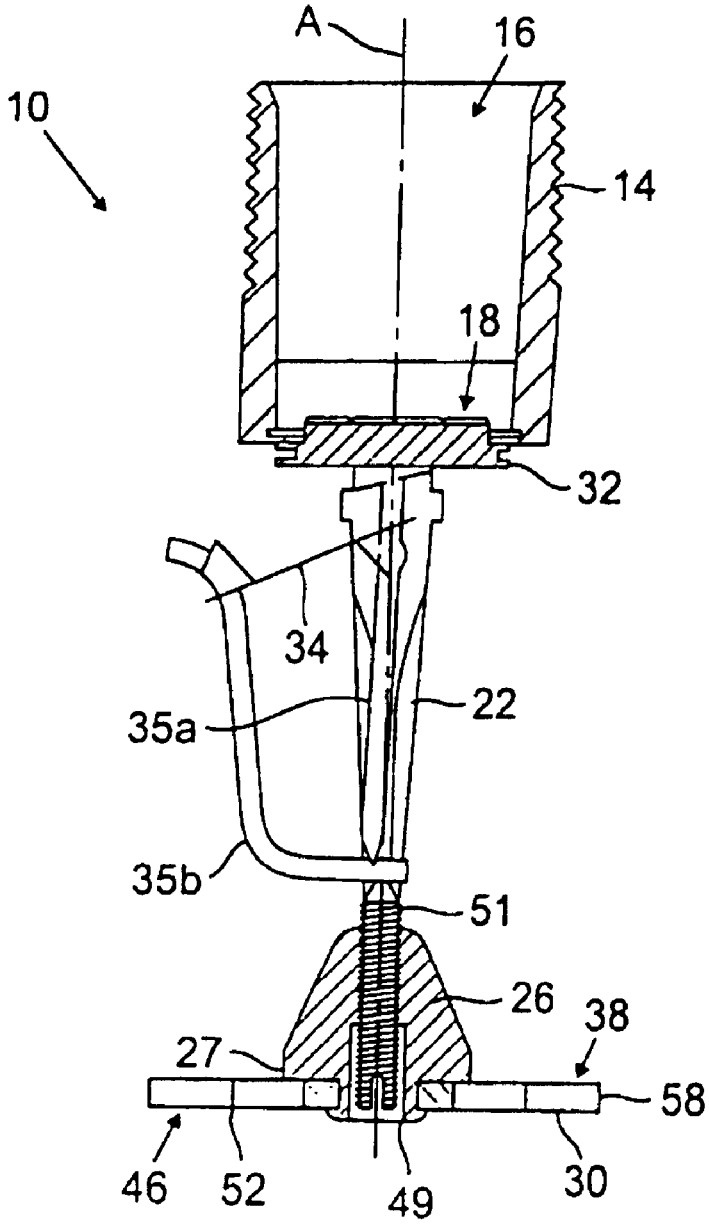
FIG. 2 is a side sectional view of the fire protection sprinkler taken at line 2—2 of FIG. 1.

Referring to FIGS. 1 and 2, a fire protection sprinkler 10 of the deflector impingement pendent-type has a body 12 with a base 14 defining an inlet 16 for connection to a source of fluid under pressure (not shown), and an outlet 18 (FIG. 2) with an axis, A. In certain embodiments, a strainer (not shown) may be located at inlet 16 to prevent debris larger than a preselected combination of dimensions from entering and clogging fluid flow through outlet 18. A pair of U-shaped frame arms 22, 24 extend from opposite sides of the base 14 to join at an apex element 26 at a position downstream of, and generally coaxial with, the outlet 18. Apex element 26 is generally conically-shaped, with the relatively wider diameter end adjacent to a water distribution deflector 30 affixed to, and disposed coaxial with, the apex element 26.

The outlet 18 of the fire protection sprinkler 10 is normally closed by a spring plate assembly 32. The assembly is held in place by a thermally responsive element 34 consisting of two thin sheet metal members secured together by a low temperature fusible solder alloy which separates and automatically releases the spring plate assembly when the thermally responsive element is heated to an elevated temperature within a specified operating temperature range for a pre-selected nominal temperature rating, e.g., 74° C. (165° F.). The retention force applied by the thermally responsive element is transmitted to the spring plate assembly 32 by the load applied through a strut 35*a* via lever 35*b*. In one particular embodiment, the thermally responsive element 34 is available, e.g., from Grinnell Corporation, of Exeter, N.H., in temperature ratings of 74° C. (165° F.) and 101° C. (214° F.).

Upon release of spring plate 32, a vertically directed, relatively coherent, single stream of fluid passes through inlet 16, rushing downward from the outlet 18 towards the deflector 30.

Heretofore, it has been known that the parameters establishing spray patterns for a pendent-type sprinkler operating by impacting a single, relatively coherent water jet against a substantially horizontal deflector, include:

- form and/or shape of the deflector support structure;
- form and/or shape of the deflector;
- outside dimensions of the deflector;
- shape and arrangement of openings and tines located around the periphery of the deflector; and
- shape, size, and arrangement of holes located within the central area of the deflector, when such holes are utilized in conjunction with slots and tines located around the periphery of the deflector.

Figure 3:
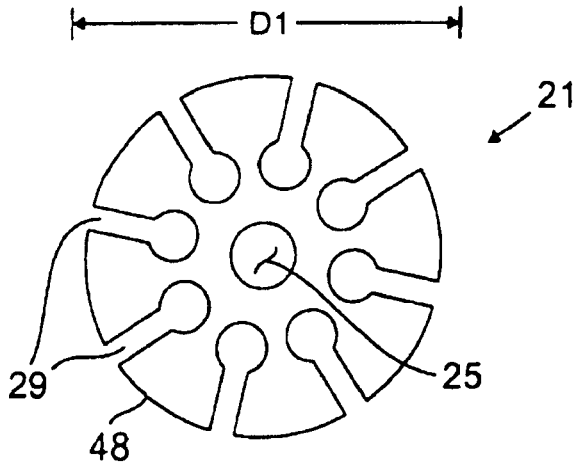
FIG. 3 is a top plan view of a deflector element for use in the fire protection sprinkler of FIG. 1.

Referring to FIG. 3, a deflector 21 of the invention for use in pendent-type fire protection sprinkler 10 has an outside diameter, $D_1$, e.g., a uniform value of about 1.75 inches. The deflector 21 has a thickness of about 0.09 inch, and it is fabricated from a phosphor bronze alloy UNS52100, per ASTM B103, with a Rockwell B Scale hardness of about 92. The diameter of deflector 21 is optimized to provide, from a predetermined height, a particular spray pattern over a desired area to be protected from fire. The outside diameter is limited by the volume of fire retardant fluid, and by the size of the orifice. Moreover, where cost is a consideration, increasing the size of the deflector diameter requires the thickness of deflector 21 to be increased in order to ensure that it has sufficient rigidity to withstand the force of the discharged stream of fluid.

The deflector 21 has an inside surface 38 (FIG. 1) downstream of, and facing towards, i.e. opposing, the deflector outlet 18, and an outside surface 46 (FIG. 1) on the opposite side of the deflector, i.e. facing away from the deflector outlet. The inside surface of the deflector 21 includes a substantially flat, central base area 48 (FIGS. 3 and 5A) having a central hole 25 for mounting to the apex element 26.

A grouping of equally spaced reentrant slots 29, e.g. at least about four, and preferably about eight, as shown in FIG. 3, are symmetrically located about the periphery of the deflector through the body of the deflector 21, i.e. from the inside surface to the opposite outside surface of the deflector. The radially innermost portions of the reentrant slots are substantially in line axially with the outer peripheral surface 27 (FIG. 2) of the apex element 26 of the sprinkler frame, or extend beneath, i.e. underlie, in the direction of fire retardant fluid flow, the outermost surface apex element 26, as shown in FIG. 2.

With this arrangement, it has been found that a relatively greater quantity of fire retardant fluid can be diverted to produce a relatively greater amount of thrust in the inner, downwardly-directed portion (i.e., the central core) of the spray pattern at lower pressures, as compared to the amount of central core thrust generated by prior art deflectors, e.g. those having straight slots or slots which are slightly tapered in a direction radially outward from the deflector axis.

Figure 4:
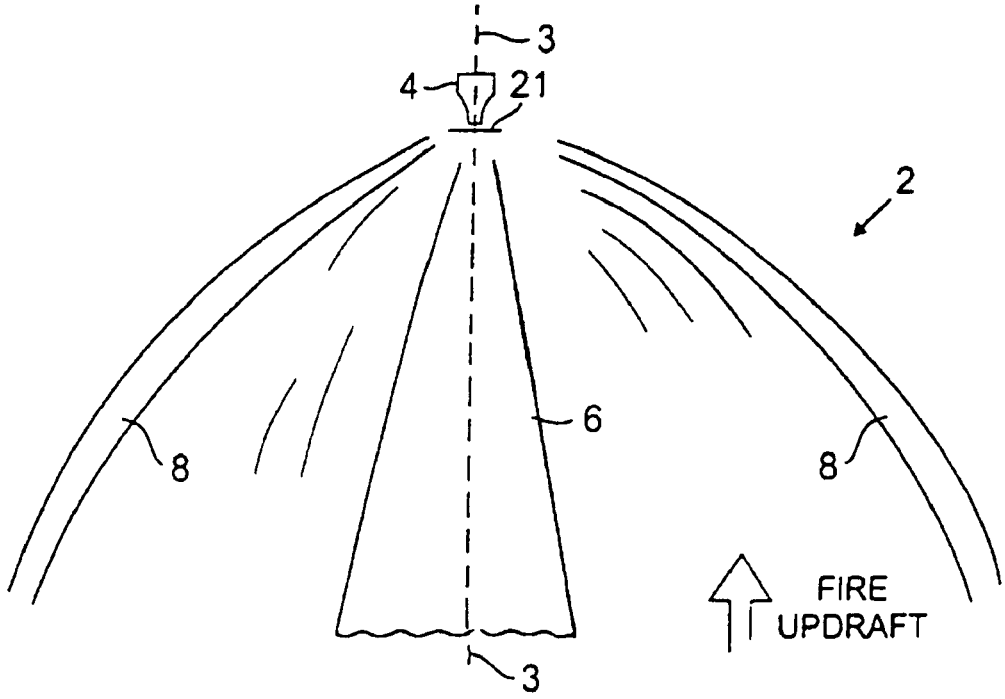
FIG. 4 illustrates a spray pattern for a fire protection sprinkler having a deflector with reentrant slots.

Referring to FIG. 4, a spray pattern for a commercial ESFR fire protection sprinkler with the deflector 21 having reentrant slots 29 is illustrated. The reentrant slots 29 result in a spray pattern 2 in which the spray direction is altered towards a center main axis 3 of a sprinkler 4. In particular, the reentrant slots 29 of the deflector result in formation of a central core 6 of spray pattern 2, with tines of the deflector resulting in formation of an outer shell 8 of spray pattern 2. In particular, the central core portion 6 of the spray pattern 2 has fluid droplets with greater momentum (i.e. mass times velocity), at relatively lower inlet pressures, than provided by prior art sprinklers of similar purpose.

As will be described in greater detail below, in other ESFR sprinkler applications, it may be desired to alter the spray pattern to provide additional concentrations of fluid spray, e.g., other than the central core and outer umbrella-shaped portions.

Figure 5:
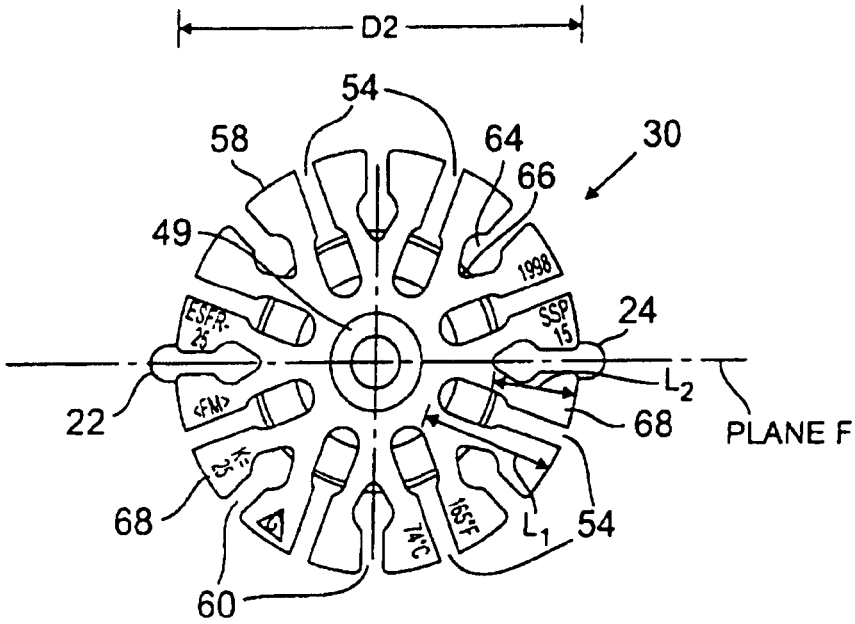
FIG. 5 is a top plan view of an alternate embodiment of a deflector element for use in the fire protection sprinkler of FIG. 1.

For example, referring to FIG. 5, the deflector 30 of the deflector impingement-type, automatic fire protection sprinkler 10 of the invention has an outside diameter, $D_2$, e.g., a uniform value of about 1.75 inches. The deflector 30, having a thickness, T (FIG. 1), e.g. about 0.09 inch, is fabricated from a phosphor bronze alloy UNS52100, per ASTM B103, with a Rockwell Scale B hardness of about 92.

Referring again to FIG. 5, as well as to FIG. 2, deflector 30 has an inside surface 38 downstream of, and facing towards, i.e. opposing, the nozzle outlet 18, and an outside surface 46 on the opposite side of the deflector, i.e. facing away from the nozzle outlet. The inside surface 38 of the deflector 30 includes a substantially flat, central base area 48 having a central hole 49 for mounting to the apex element 26.

Figure 5A:
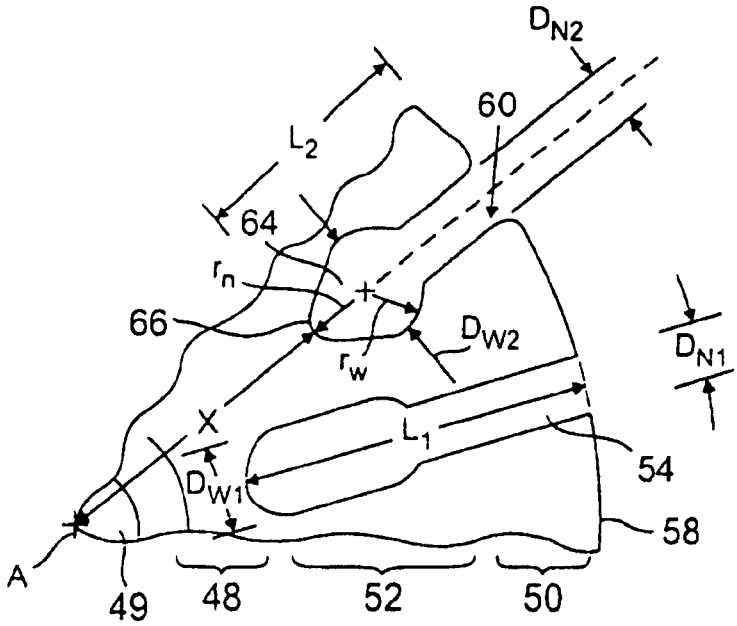
FIG. 5A is a similar enlarged view of the region A—A of FIG. 5.

Referring particularly to FIGS. 5 and 5A, a first grouping of a first type of equally spaced reentrant slots 54, e.g., preferably at least one pair of generally opposing reentrant slots, more preferably at least two pairs of generally opposing slots, and most preferably about four pairs of generally opposing slots, are symmetrically located around the periphery of deflector 30 and extend from the inside surface 38 to the opposite outside surface 46, and thus through the body of the deflector 30. Each reentrant slot 54 extends a radial length $L_1$, e.g., in the range of about 0.52 inch to about 0.62 inch, and preferably about 0.57 inch, from an outer peripheral edge 58 of the deflector inward towards base area 48. The reentrant slots 54 are elongated in shape and angularly spaced from each other in a range between about 40° to 50 ° and preferably, as shown here, the angular spacing is about 45°. Further, the elongated reentrant slots 54 have a first width, $D_{n1}$, measured transversely to the slot centerline in a region of the peripheral edge 58, in the range of about 0.08 inch to 0.010 inch, and preferably about 0.09 inch, and a second width, $D_{w1}$, measured transversely to the slot centerline in a region spaced inwardly from the peripheral edge, in the range of about 0.13 inch to 0.17 inch, and preferably about 0.15 inch.

A second grouping of a second type of equally spaced reentrant slots 60 (e.g., preferably at least one pair of generally opposing slots, more preferably at two pairs of generally opposing slots, and most preferably at least four pairs of generally opposing slots, as shown in FIG. 5) are symmetrically positioned between adjacent reentrant slots 54. Referring also to FIG. 5A, like reentrant slots 54, reentrant slots 60 extend from inside surface 38 to opposite outside surface 46, through the body of deflector 30. Moreover, reentrant slots 60 extend from outer peripheral edge 58 of the deflector towards base area 48 by a radial length $L_2$, e.g., in the range of about 0.32 inch to about 0.42 inch, and preferably about 0.37 inch. Reentrant slots 60 are preferably pear-shaped and extend into an intermediate region 52, with a relatively wider end 64 of each reentrant slot 60 having a radius, $r_w$, e.g., in the range of about 0.04 inch to about 0.08 inch, and preferably about 0.06 inch. The innermost, narrower end 66 of each slot 60, located relatively closer to the deflector axis, A, than the wider portion 64, has a radius, $r_n$, e.g., in the range of about 0.04 inch to about 0.06 inch, and preferably about 0.05 inch. Reentrant slots 60 are angularly spaced from each other in the range of between about 40° to 50° and preferably, as shown here, the angular spacing is about 45°. Further, the generally triangular-shaped or, more specifically, pear-shaped reentrant slots 60 have a first width, $D_{n2}$, measured transversely to the slot centerline in a region of the peripheral edge 58, in the range of about 0.08 inch to 0.10 inch, and preferably about 0.09 inch, and a second width, $D_{w2}$, measured transversely to the slot centerline in a region spaced inwardly from the peripheral edge, in the range of 0.16 inch to 0.20 inch, and preferably about 0.18 inch.

Tines 68 are defined by that portion of the deflector body extending from central base area 48 and including those regions between reentrant slots 54 and reentrant slots 60. The shape of reentrant slots 60 is somewhat dependent on the shape of reentrant slots 54. In particular, the pear-shape of reentrant slots 60 ensures that the width of tines 68 between reentrant slots 54 and 60 is sufficient to provide the desired structural rigidity to the deflector body, as well as to facilitate manufacture of the body, e.g., when stamped or machined.

Figure 6:
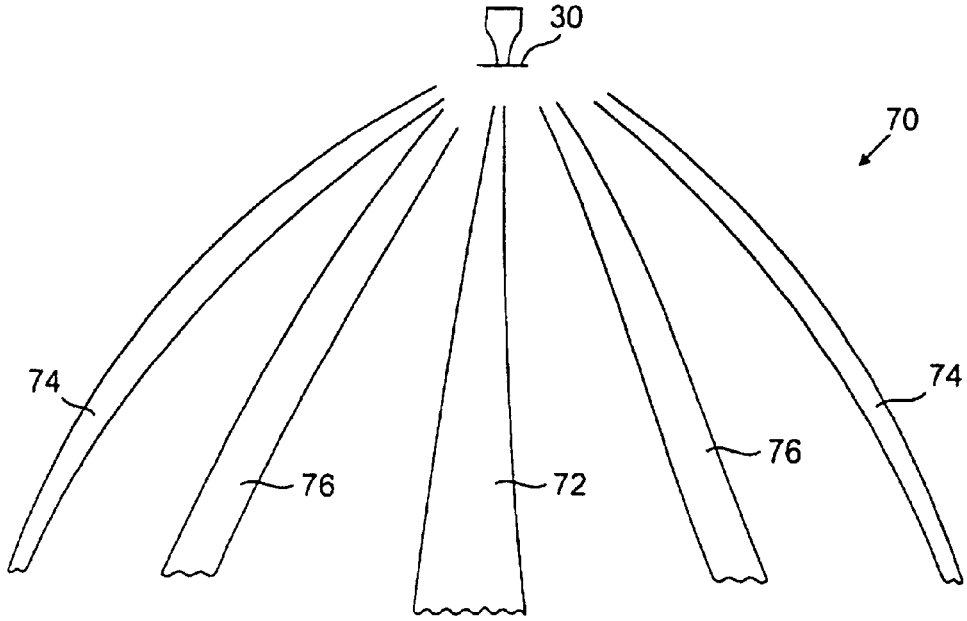
FIG. 6 illustrates a spray pattern provided by the fire protection sprinkler using the deflector element of FIG. 5.

Referring to FIG. 6, in operation, a stream of fire retardant fluid, e.g. water, from the outlet 18 impacting upon the opposed, inside surface 38 of the deflector 30 is diverted generally radially downward and outward by the deflector, being broken into a spray pattern consisting of a superimposed combination of an outer, umbrella-shaped pattern component, an intermediate, componentized spray pattern component, and an inner, generally conical-shaped pattern component, the configuration of the spray pattern being primarily a function of deflector design.

Referring to FIG. 6, and in contrast to FIG. 4, automatic fire protection sprinkler 10 having deflector 30, in operation, provides a spray pattern 70 well-suited for ESFR sprinkler applications. In particular, reentrant slots 54 cause the spray to form a central core 72, tines 68 cause the spray to form an outer shell 74, and reentrant slots 60 cause the spray to form secondary thrust regions 76 in an intermediate zone, between central core 72 and outer shell 74, of the spray pattern 70.

In addition, referring again to FIG. 5, in a preferred embodiment, deflector 30 is positioned with a pair of reentrant slots 60 disposed in plane, F, of the sprinkler frame arms 22, 24.

A commercial embodiment of the automatic fire protection sprinkler 10 of the invention is represented by a 25.2 K-Factor, Model ESFR-25™ pendent sprinkler assembly, available from Grinnell Corporation, 3 Tyco Park, Exeter, N.H. 03833.

The 25.2 K-Factor, Model ESFR-25™ pendent sprinkler is listed and approved by Factory Mutual Research Corporation (FM) as an "Early Suppression Fast Response Pendent Sprinkler" designed for use with wet pipe, automatic sprinkler systems for the fire protection of high-piled storage. The Model ESFR-25™ pendent sprinkler is a suppression mode sprinkler, and its use is especially advantageous as a means for eliminating use of in-rack sprinklers. Acceptable storage arrangements which can be protected by the Model ESFR-25™ pendent sprinkler include open-frame single-row rack, double-row rack, multiple-row rack, and portable rack storage, as well as palletized and solid-piled storage, of most encapsulated or non-encapsulated, common materials including cartoned unexpanded plastics. In addition, the protection of some storage arrangements of roll paper and rubber tires can be considered as well.

The FM listing and approval of the Model ESFR-25™ pendent sprinkler permits it to be used to protect encapsulated and non-encapsulated, Class I, II, III and IV, as well as cartoned unexpanded plastics, at design pressures based on maximum storage and ceiling heights, as shown in Table I, below.

TABLE I

| Maximum Storage Height, Ft. (m) | Maximum Ceiling Height, Ft. (m) | Minimum Flowing Pressure, psi (bar) |
|---|---|---|
| 40 (12.2) | 45 (13.7) | 50 (3.4) |
| 35 (10.7) | 40 (12.2) | 40 (2.7) |
| 30 (9.1) | 35 (10.7) | 30 (2.1) |
| 25 (7.6) | 30 (9.1) | 20 (1.4) |

The FM listing and approval of the Model ESFR-25™ pendent sprinkler permits it to be used to protect heavy and medium weight paper storage, as indicated in Table II, below. These guidelines are applicable to banded or unbanded rolls in open, standard, or closed array. The design includes a hose stream allowance of 250 gpm (950 lpm), and the water supply duration is to be a minimum of 1 hour.

TABLE II

| Maximum Storage Height, Ft. (m) | Maximum Ceiling Height, Ft. (m) | Minimum Flowing Preusure, psi (bar) |
|---|---|---|
| Heavy weight | | |
| 25 (7.6) | 30 (9.1) | 20 (1.4) |
| 30 (9.1) | 40 (12.2) | 40 (2.7) |
| 30 (9.1) | 45 (13.7) | 50 (3.4) |

TABLE II-continued

| Maximum Storage Height, Ft. (m) | Maximum Ceiling Height, Ft. (m) | Minimum Flowing Preusure, psi (bar) |
|---|---|---|
| Plastic Coated Heavy Weight | | |
| 20 (6.1) | 30 (9.1) | 20 (1.4) |
| 20 (6.1) | 40 (12.2) | 40 (2.7) |
| Medium Weight | | |
| 20 (6.1) | 30 (9.1) | 20 (1.4) |
| 20 (6.1) | 40 (12.2) | 40 (2.7) |

The FM listing and approval of the Model ESFR-25™ pendent sprinkler also permits its use for protection of on-side and on-tread (not interlaced) storage of rubber tires in open frame racks to a maximum height of 25 feet (7.6 m) under ceilings no higher than 30 feet (9.1 m). The sprinkler system must be designed to supply twelve sprinklers at 20 psi (1.4 bar), flowing four sprinklers per branch on three branch lines. Sprinklers must be rated 165°/74° C. All other guidelines of FM Loss Prevention Data Sheet 2—2 must be followed, except that the hose stream demand must be 500 gpm (1900 lpm) and the water supply duration must be a minimum of 2 hours.

The 25.2 K-Factor, Model ESFR-25™ pendent sprinkler is also listed by Underwriters Laboratories Inc. (UL) and by UL for use in Canada (C-UL) as a "Specific Application Early Suppression Fast Suppression Sprinkler" for use in accordance with NFPA 13, NFPA 231, and NFPA 231C (the complete disclosures of each of which are incorporated herein by reference) to protect single-row rack, double-row rack, and multiple row rack storage (no open top containers or solid shelves) and palletized and solid pile storage (no open containers or solid shelves), of most encapsulated or non-encapsulated, common (Class I, II, III and IV commodities) materials, including cartoned unexpanded plastics, when installed with the maximum ceiling and storage heights and minimum design pressures shown in Table III, below.

TABLE III

| Maximum Storage Height, Ft. (m) | Maximum Ceiling Height, Ft. (m) | Minimum Flowing Pressure, psi (bar) |
|---|---|---|
| 40 (12.2) | 45 (13.7) | 40 (2.7) |
| 35 (10.7) | 40 (12.2) | 25 (1.7) |
| 30 (9. 1) | 35 (10.7) | 20 (1.4) |
| 25 (7.6) | 30 (9.1) | 15 (1.0) |

In particular, the Model ESFR-25™ pendent sprinkler is designed to operate at substantially lower end head pressures, as compared to ESFR sprinklers having a nominal K-Factor of 14. This feature offers flexibility when sizing the system piping, as well as possibly reducing or eliminating the need for a system fire pump. Also, the Model ESFR-25™ pendent sprinkler permits use of a maximum deflector-to-ceiling distance of 18 inches (460 mm), as compared to a maximum of 14 inches (360 mm) for ESFR sprinklers with a K-factor of 14.

Using a Model ESFR-25™ pendent sprinkler assembly, data was collected for comparison of fluid densities released over an area representing the top of stacked commodities, e.g., boxes, in a warehouse setting.

Referring to FIGS. 7–10, the test area is shown as a pictorial array defining 0.5 meter square regions 90 representing the top surfaces of the stacked commodities, surrounded by flue regions 92, i.e., spaces between the stacked commodities, e.g., about six inches wide. A discharging sprinkler 94 is centrally located at point 96. The vertical distance between the sprinkler deflector and the top of the fluid collector area is 8 feet, 6 inches.

In each region there is shown a fluid density value representing the actual measured amount of fluid volume, in gallons per minute per square foot, falling within that region. The fluid density values are employed to determine weighted average values of ADD (Actual Delivered Density) over different regions of the array. Of particular interest is the region identified as "central core ADD" which represents a weighted average of the central sixteen square regions 90 and the four flue regions surrounding point 96.

Figure 7:
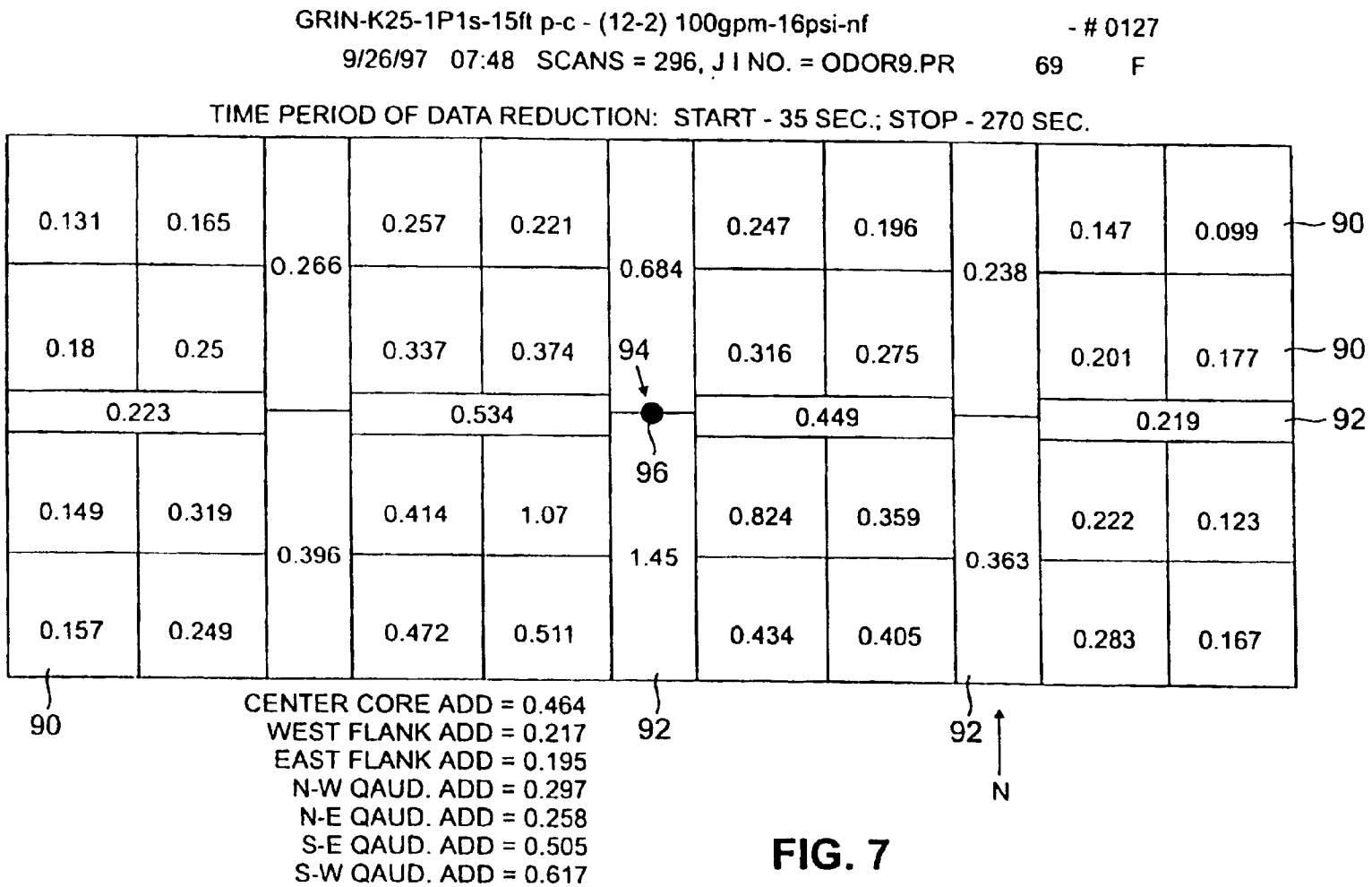
FIG. 7 PRIOR ART
FIG. 7 is a chart of ADD test data in a no-fire, water spray only condition for a typical straight-slotted deflector.
Figure 8:
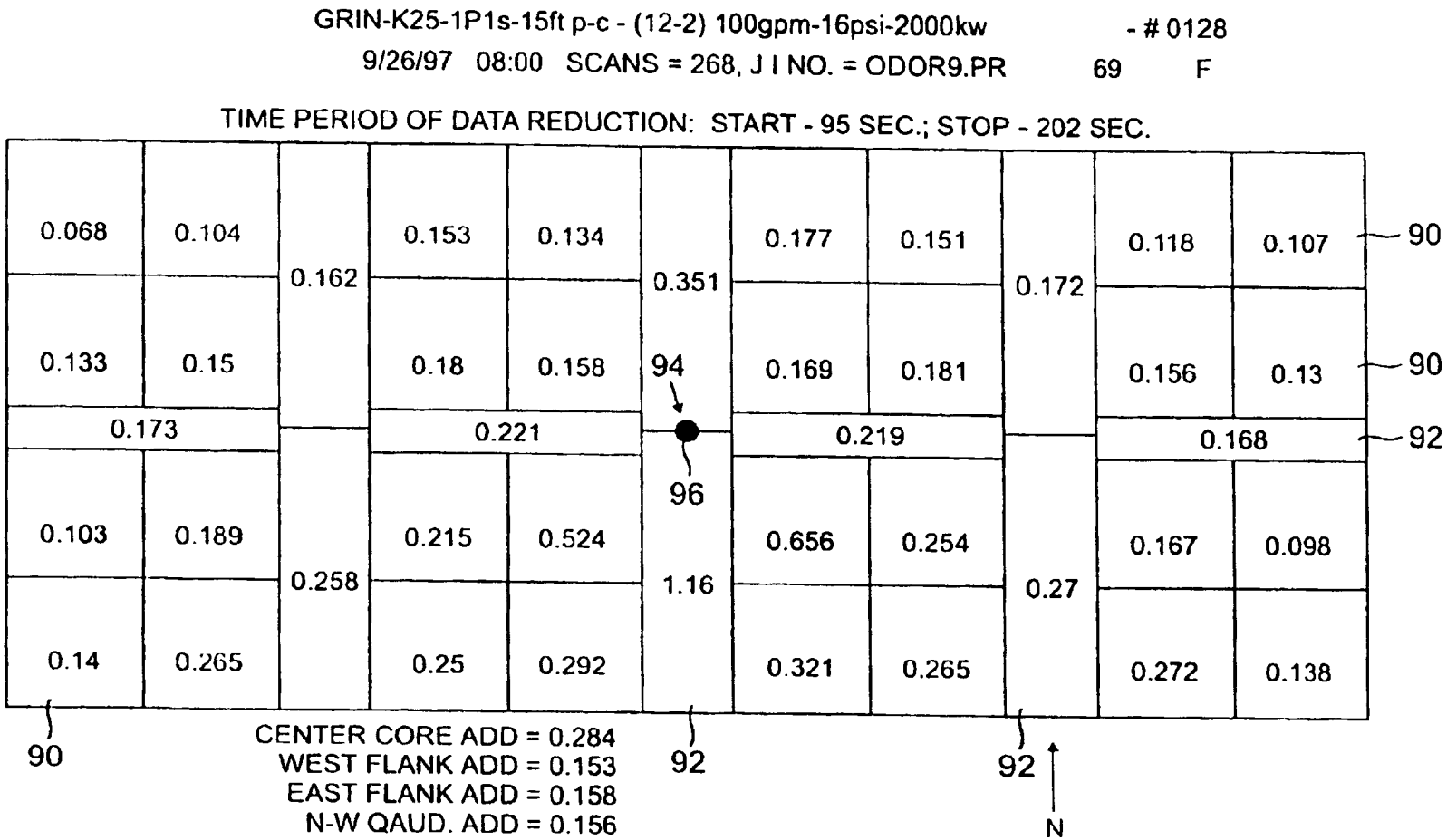
FIG. 8 PRIOR ART
FIG. 8 is a chart of ADD test data with a simulated 2,000 kw fire located directly beneath the primary axis of the sprinkler for the same typical straight-slotted deflector.

Referring to FIG. 7, fluid density data collected using a conventional (prior art) deflector affixed to a 25.2 K-factor sprinkler with straight slots in a no-fire, water spray only condition is shown. FIG. 8 shows the fluid density data collected using the same straight-slotted deflector design in a 2,000 kw fire located directly below the primary vertical axis of the discharging 25.2 K-factor sprinkler 94. The data shows that a substantial reduction in the collected densities of fire protection fluid occurs when the sprinkler is tested with a 2,000 kw fire.

Figure 9:
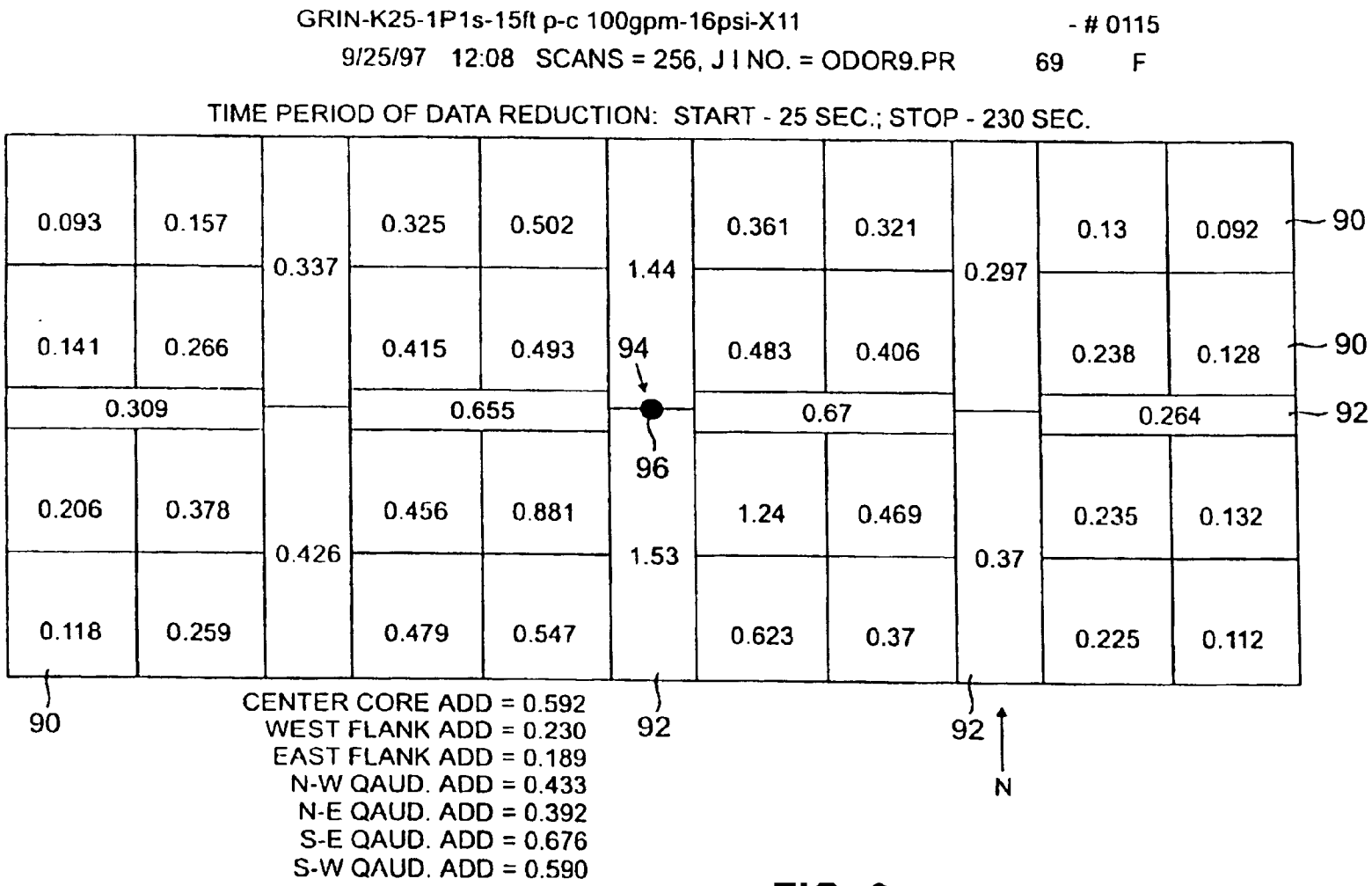
FIG. 9 is a chart of ADD test data in a no-fire, water spray only condition using a sprinkler having a deflector in accordance with the invention.
Figure 10:
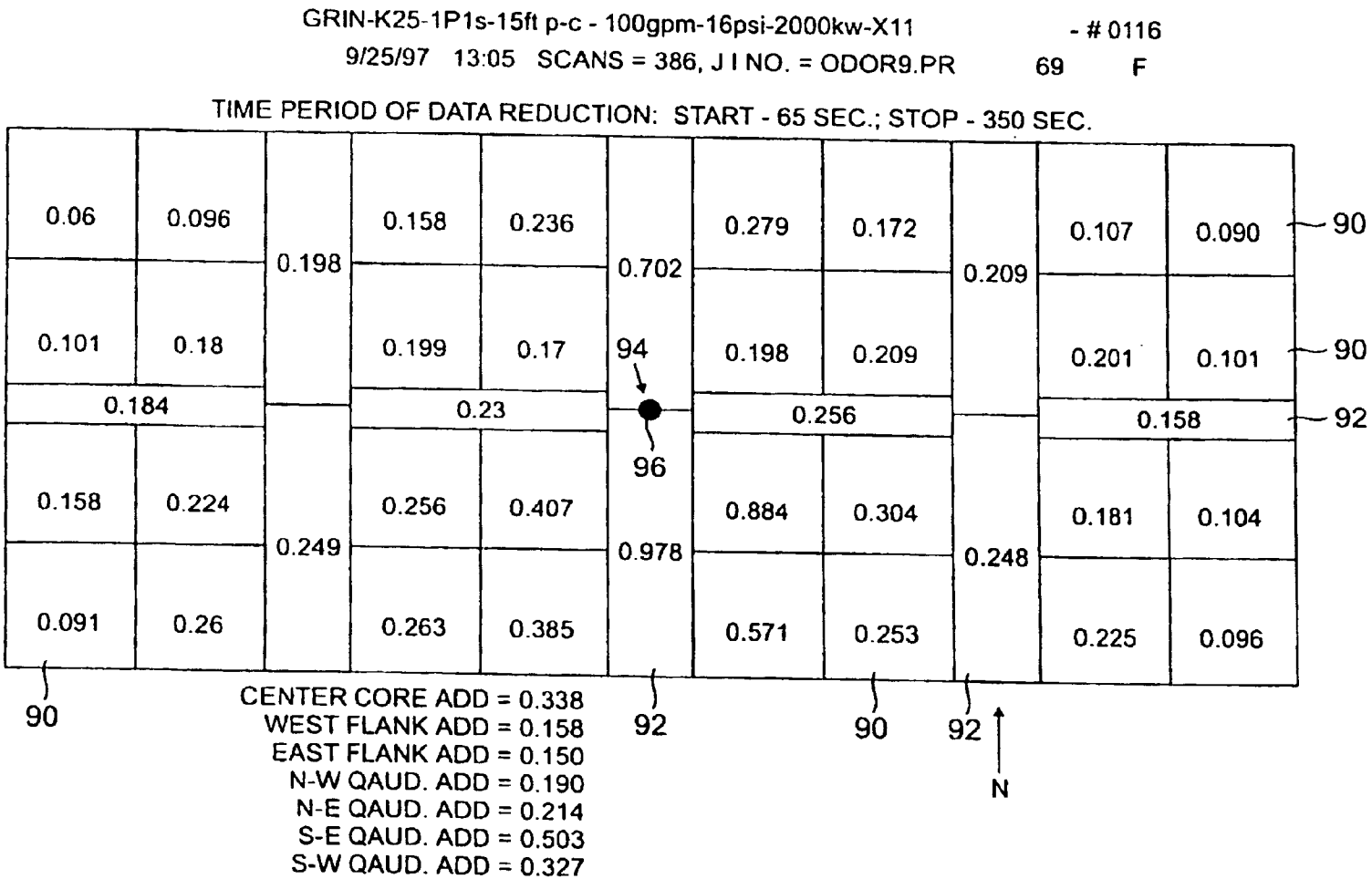
FIG. 10 is a chart of ADD test data with a simulated 2,000 kw fire located directly beneath the primary axis of the sprinkler using a sprinkler having a deflector in accordance with the invention.

Referring to FIGS. 9 and 10, fluid density data collected using a 25.2 K-factor fire protection sprinkler with a deflector 30 in accordance with the invention is shown. In particular, FIG. 9 represents collected data in the no-fire, water spray only condition and FIG. 10 represents collected data in the 2,000 kw fire condition. The aforementioned tests were conducted under identical pressure and flow conditions. Of particular interest is the substantial increase in center core ADD provided by the sprinkler having the deflector 30 of the invention, as compared to the conventional straight-slotted deflector. Moreover, this increase in center core ADD performance is achieved with substantially no sacrifice in performance at peripheral regions.

Another type of water distribution test, the so-called "10 Pan Distribution Test," such as that described in the Apr. 8, 1997, edition of UL 199, Standard for Automatic Sprinklers for Fire-Protection Service, the complete disclosure of which is incorporated herein by reference, provides another means for describing the benefit of use of reentrant slots and, in particular, the reentrant slots 60 of the deflector 30 of this invention. Referring to FIG. 30.1 of the Apr. 8, 1997 edition of UL 199, with a 25.2 K-factor conventional (prior art) sprinkler having straight slots and in a no-fire, water spray only condition, an average water density of about 0.82 gallon per minute per square foot was measured in the 1 foot long by 1 foot wide pan centered at a 3 foot radius from the primary vertical axis of the sprinkler when it was flowing 100 gallons per minute. By comparison, with a 25.2 K-factor fire protection sprinkler having a deflector 30 in accordance with the invention, an average water density of about 1.3 gallons per minute per square foot was measured in the 1 foot long by 1 foot wide pan centered at a 3 foot radius from the primary vertical axis of the sprinkler when it was flowing 100 gallons per minute.

Other embodiments are within the following claims. For example, the outlet 18 may have a non-circular cross-section. The sprinkler 10 may have a K-factor in the range of about 8.0 to 50.0, preferably in the range from about 14.0 to 30.0, more preferably in the range of about 22.0 to about 28.0, and most preferably the K-factor is about 25.0.

Deflectors of the invention having one group of reentrant slots, e.g. slots 27 of deflector 21 (FIG. 3), may have slots of different lengths. In deflectors of the invention having two groups of reentrant slots, e.g. slots 54, 60 of deflector 30

(FIG. 5), slots within each group of slots may also have different lengths, and/or a third set of reentrant slots or holes may be employed to provide a different spray pattern. In deflectors of the invention having three groups of reentrant slots, the slots may be arranged in a pattern such as abcbabcba. The numbers of reentrant slots in each group also may vary. Moreover, the slots need not extend radially to the periphery of the deflector but may be provided in non-radial arrangements.

The peripheral edge 58 of the outer area 50 of the deflector 30 may define ridges in the radial outward direction from the deflector axis. Although deflector 30 is described above as a plate-like member, the deflector need not be flat but may, e.g., be wavy or frusto-conical in shape. The deflector 30 may also have variations in the shape and dimensions of the reentrant slots 60 through the intermediate region 52 of the deflector inner surface 38, e.g., referring also to FIG. 5A, in length, $L_2$, radius, $r_n$, and/or radius, $r_w$, and/or radial spacing, X, from the deflector axis, A. Frame arms 22, 24 can have a wide variety of shapes, mounting or support arrangements, e.g., the deflector 30 may be positioned inside, rather than outside, frame arms 22, 24, and the frame arms may be affixed to the deflector 30, rather than to the apex element 26.

The apex element 26 need not be generally conically-shaped, as shown in FIG. 2, but may be curved in the direction of the orifice axis, e.g., to achieve specific water distribution objectives. Opposing vertical sides of the reentrant slots may not be identical.

All of the above are applied without departing from the spirit and scope of this invention.

What is claimed is:

1. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 30 feet in a storage area having a maximum ceiling height of 35 feet, with no open containers and no solid shelves, said sprinkler having a K-factor of about 25 and a minimum design flowing pressure of about 20 pounds per square inch, and less than about 45 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

2. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 35 feet in a storage area having a maximum ceiling height of 40 feet, with no open containers and no solid shelves, said sprinkler having a K-factor of about 25 and a minimum design flowing pressure of about 25 pounds per square inch, and less than about 50 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

3. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 40 feet in a storage area having a maximum ceiling height of 45 feet, with no open containers and no solid shelves, said sprinkler having a K-factor of about 25 and a minimum design flowing pressure of about 40 pounds per square inch, and less than about 65 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

4. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 25 feet in a storage area having a maximum ceiling height of 30 feet, with no open containers and no solid shelves, said sprinkler having a K-factor of about 25 and a minimum design flowing pressure of about 15 pounds per square inch, and less than about 40 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

5. The early suppression fast response pendent-type fire protection sprinkler of claim 4, 1, 2, or 3, wherein said reentrant slots extend inwardly along reentrant slot centerlines, and each of said reentrant slots has a first width transverse to its reentrant slot centerline in a region of said peripheral edge and a second slot width transverse to its reentrant slot centerline in a region spaced inwardly, toward said deflector axis, relative to the region of said peripheral edge, said second width being greater than said first width.

6. The early suppression fast response pendent-type fire protection sprinkler of claim 5, further comprising an apex element and wherein said deflector is mounted to said apex element and wherein an innermost portion of each of said reentrant slots extends inwardly toward said deflector axis to be no further outward from said deflector axis that an outermost surface of said apex element.

7. The early suppression fast response pendent-type fire protection sprinkler of claim 6, wherein said innermost portions of said reentrant slots extend inwardly toward said deflector axis to underlie said apex element, relative to fluid flow direction from said outlet.

8. The early suppression fast response pendent-type fire protection sprinkler of claim 5, wherein said reentrant slot centerlines extend radially outward from said deflector axis.

9. The early suppression fast response pendent-type fire protection sprinkler of claim 4, 1, 2, or 3, wherein said sprinkler is suited for installation with said deflector disposed up to 18 inches below a ceiling.

10. The early suppression fast response pendent-type fire protection sprinkler of claim 4, 1, 2 or 3, wherein said deflector has a thickness measured from said first surface in the direction of fluid flow equal to or greater than about 0.06 inch.

11. The early suppression fast response pendent-type fire protection sprinkler of claim 4, 1, 2, or 3, wherein said reentrant slots comprise a plurality of reentrant slots, said plurality of reentrant slots comprising at least a first type of reentrant slots and a second type of reentrant slots, reentrant slots of said first type extending from said first surface through said deflector with the slot openings at an outer peripheral edge of said deflector body, each of said reentrant slots of said first type extending inwardly from said peripheral edge, along the reentrant slot centerlines, generally toward said deflector axis, to a first type length, reentrant slots of said second type extending through said deflector from said first surface, with the slot openings at said peripheral edge of said deflector body, each of said reentrant slots of said second type extending inwardly from said peripheral edge, along the reentrant slot centerlines, generally toward said deflector axis, to a second type length, and the innermost portions of said reentrant slots of said first type extending inwardly toward said deflector axis to be no further outward from said deflector axis than the outermost surface of said apex element.

12. The early suppression fast response pendent-type fire protection sprinkler of claim 11, wherein:

each of said reentrant slots of said first type has a first width transverse to its slot centerline in a region of said peripheral edge and a second width transverse to its slot centerline in a region spaced inwardly, toward said deflector axis, relative to the region of said peripheral edge, the second said width of said first type slots being greater than the first said width of said first type slots, and each of said reentrant slots of said second type has a first width transverse to its slot centerline in a region of said peripheral edge and a second width transverse to its slot centerline in a region spaced inwardly, toward said deflector axis, relative to the region of said peripheral edge, the second said width of said second type slots being greater than the first said width of said second type slots.

13. The early suppression fast response pendent-type fire protection sprinkler of claim 11, wherein said first type length is equal to or greater than said second type length.

14. The early suppression fast response pendent-type fire protection sprinkler of claim 13, wherein said reentrant slot centerlines of said reentrant slots of said first type extend substantially radially outward from said deflector axis.

15. The early suppression fast response pendent-type fire protection sprinkler of claim 14, wherein said reentrant slot centerlines of said reentrant slots of said second type extend substantially radially outward from said deflector axis.

16. The early suppression fast response pendent-type fire protection sprinkler of claim 11, wherein said reentrant slots of said first type comprise at least two pairs of generally opposing reentrant slots.

17. The early suppression fast response pendent-type fire protection sprinkler of claim 11, wherein said reentrant slots of said second type comprise at least two pairs of generally opposing reentrant slots.

18. The early suppression fast response pendent-type fire protection sprinkler of claim 11, wherein said first type length of said reentrant slots of said first type is substantially the same.

19. The early suppression fast response pendent-type fire protection sprinkler of claim 11, wherein said second type length of said reentrant slots of said second type is substantially the same.

20. The early suppression fast response pendent-type fire protection sprinkler of claim 11, wherein said reentrant slots of said first type define reentrant portions having an elongated shape.

21. The early suppression fast response pendent-type fire protection sprinkler of claim 11, wherein said reentrant slots of said second type define reentrant portions having a pear-shape.

22. The early suppression fast response pendent-type fire protection sprinkler of claim 11, wherein a reentrant slot of said second type is located between reentrant slots of said first type.

23. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 25 feet in a storage area having a maximum ceiling height of 30 feet, with no open containers and no solid shelves, said sprinkler having a K-factor of about 25 or more and a minimum design flowing pressure of about 15 pounds per square inch, and less than about 40 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

24. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 30 feet in a storage area having a maximum ceiling height of 35 feet, with no open containers and no solid shelves, said sprinkler having a K-factor of about 25 or more and a minimum design flowing pressure of about 20 pounds per square inch, and less than about 45 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

25. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 35 feet in a storage area having a maximum ceiling height of 40 feet, with no open containers and no solid shelves, said sprinkler having a K-factor of about 25 or more and a minimum design flowing pressure of about 25 pounds per square inch, and less than about 50 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

26. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 40 feet in a storage area having a maximum ceiling height of 45 feet, with no open containers and no solid shelves, said sprinkler having a K-factor of about 25 or more and a minimum design flowing pressure of about 40 pounds per square inch, and less than about 65 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

27. The early suppression fast response pendent-type fire protection sprinkler of claim 23, 24, 25, or 26, wherein said reentrant slots extend inwardly along reentrant slot centerlines, and each of said reentrant slots has a first width transverse to its reentrant slot centerline in a region of said peripheral edge and a second slot width transverse to its reentrant slot centerline in a region spaced inwardly, toward said deflector axis, relative to the region of said peripheral edge, said second width being greater than said first width.

28. The early suppression fast response pendent-type fire protection sprinkler of claim 27, further comprising an apex element and wherein said deflector is mounted to said apex element and wherein an innermost portion of each of said reentrant slots extends inwardly toward said deflector axis to be no further outward from said deflector axis that an outermost surface of said apex element.

29. The early suppression fast response pendent-type fire protection sprinkler of claim 28, wherein said innermost portions of said reentrant slots extend inwardly toward said deflector axis to underlie said apex element, relative to fluid flow direction from said outlet.

30. The early suppression fast response pendent-type fire protection sprinkler of claim 27, wherein said reentrant slot centerlines extend radially outward from said deflector axis.

31. The early suppression fast response pendent-type fire protection sprinkler of claim 23, 24, 25, or 26, wherein said sprinkler is suited for installation with said deflector disposed up to 18 inches below a ceiling.

32. The early suppression fast response pendent-type fire protection sprinkler of claim 23, 24, 25, or 26, wherein said deflector has a thickness measured from said first surface in the direction of fluid flow equal to or greater than about 0.06 inch.

33. The early suppression fast response pendent-type fire protection sprinkler of claim 23, 24, 25, or 26, wherein said reentrant slots comprise a plurality of reentrant slots, said plurality of reentrant slots comprising at least a first type of reentrant slots and a second type of reentrant slots, reentrant slots of said first type extending from said first surface through said deflector with the slot openings at an outer peripheral edge of said deflector body, each of said reentrant slots of said first type extending inwardly from said peripheral edge, along the reentrant slot centerlines, generally toward said deflector axis, to a first type length, reentrant slots of said second type extending through said deflector from said first surface, with the slot openings at said peripheral edge of said deflector body, each of said reentrant slots of said second type extending inwardly from said peripheral edge, along the reentrant slot centerlines, generally toward said deflector axis, to a second type length, and the innermost portions of said reentrant slots of said first type extending inwardly toward said deflector axis to be no further outward from said deflector axis than the outermost surface of said apex element.

34. The early suppression fast response pendent-type fire protection sprinkler of claim 33, wherein:

each of said reentrant slots of said first type has a first width transverse to its slot centerline in a region of said peripheral edge and a second width transverse to its slot centerline in a region spaced inwardly, toward said deflector axis, relative to the region of said peripheral edge, the second said width of said first type slots being greater than the first said width of said first type slots, and each of said reentrant slots of said second type has a first width transverse to its slot centerline in a region of said peripheral edge and a second width transverse to its slot centerline in a region spaced inwardly, toward said deflector axis, relative to the region of said peripheral edge, the second said width of said second type slots being greater than the first said width of said second type slots.

35. The early suppression fast response pendent-type fire protection sprinkler of claim 33, wherein said first type length is equal to or greater than said second type length.

36. The early suppression fast response pendent-type fire protection sprinkler of claim 35, wherein said reentrant slot centerlines of said reentrant slots of said first type extend substantially radially outward from said deflector axis.

37. The early suppression fast response pendent-type fire protection sprinkler of claim 36, wherein said reentrant slot centerlines of said reentrant slots of said second type extend substantially radially outward from said deflector axis.

38. The early suppression fast response pendent-type fire protection sprinkler of claim 33, wherein said reentrant slots of said first type comprise at least two pairs of generally opposing reentrant slots.

39. The early suppression fast response pendent-type fire protection sprinkler of claim 33, wherein said reentrant slots of said second type comprise at least two pairs of generally opposing reentrant slots.

40. The early suppression fast response pendent-type fire protection sprinkler of claim 33, wherein said first type length of said reentrant slots of said fist type is substantially the same.

41. The early suppression fast response pendent-type fire protection sprinkler of claim 33, wherein said second type length of said reentrant slots of said second type is substantially the same.

42. The early suppression fast response pendent-type fire protection sprinkler of claim 33, wherein said reentrant slots of said first type define reentrant portions having an elongated shape.

43. The early suppression fast response pendent-type fire protection sprinkler of claim 33, wherein said reentrant slots of said second type define reentrant portions having a pear-shape.

44. The early suppression fast response pendent-type fire protection sprinkler of claim 33, wherein a reentrant slot of said second type is located between reentrant slots of said first type.

45. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 25 feet in a storage area having a maximum ceiling height of 30 feet, with no open containers and no solid shelves, said sprinkler having a minimum design flowing pressure of about 15 pounds per square inch, and less than about 40 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

46. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 30 feet in a storage area having a maximum ceiling height of 35 feet, with no open containers and no solid shelves, said sprinkler having a minimum design flowing pressure of about 20 pounds per square inch, and less than about 45 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

47. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 35 feet in a storage area having a maximum ceiling height of 40 feet, with no open containers and no solid shelves, said sprinkler having a minimum design flowing pressure of about 25 pounds per square inch, and less than about 50 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

48. An early suppression fast response pendent-type fire protection sprinkler suitable for use in accordance with one or more of NFPA 13, NFPA 231 and NFPA 231C, to protect single row rack storage, double row rack storage and multiple row rack storage having a maximum storage height of 40 feet in a storage area having a maximum ceiling height of 45 feet, with no open containers and no solid shelves, said sprinkler having a minimum design flowing pressure of about 40 pounds per square inch, and less than about 65 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

49. The early suppression fast response pendent-type fire protection sprinkler of claim 45, 46, 47, or 48, wherein said reentrant slots extend inwardly along reentrant slot centerlines, and each of said reentrant slots has a first width transverse to its reentrant slot centerline in a region of said peripheral edge and a second slot width transverse to its reentrant slot centerline in a region spaced inwardly, toward said deflector axis, relative to the region of said peripheral edge, said second width being greater than said first width.

50. The early suppression fast response pendent-type fire protection sprinkler of claim 49, further comprising an apex element and wherein said deflector is mounted to said apex element and wherein an innermost portion of each of said reentrant slots extends inwardly toward said deflector axis to be no further outward from said deflector axis that an outermost surface of said apex element.

51. The early suppression fast response pendent-type fire protection sprinkler of claim 50, wherein said innermost portions of said reentrant slots extend inwardly toward said deflector axis to underlie said apex element, relative to fluid flow direction from said outlet.

52. The early suppression fast response pendent-type fire protection sprinkler of claim 49, wherein said reentrant slot centerlines extend radially outward from said deflector axis.

53. The early suppression fast response pendent-type fire protection sprinkler of claim 45, 46, 47, or 48, wherein said sprinkler is suited for installation with said deflector disposed up to 18 inches below a ceiling.

54. The early suppression fast response pendent-type fire protection sprinkler of claim 45, 46, 47, or 48, wherein said deflector has a thickness measured from said first surface in the direction of fluid flow equal to or greater than about 0.06 inch.

55. The early suppression fast response pendent-type fire protection sprinkler of claim 45, 46, 47, or 48, wherein said reentrant slots comprise a plurality of reentrant slots, said plurality of reentrant slots comprising at least a first type of reentrant slots and a second type of reentrant slots, reentrant slots of said first type extending from said first surface through said deflector with the slot openings at an outer peripheral edge of said deflector body, each of said reentrant slots of said first type extending inwardly from said peripheral edge, along the reentrant slot centerlines, generally toward said deflector axis, to a first type length, reentrant slots of said second type extending through said deflector from said first surface, with the slot openings at said peripheral edge of said deflector body, each of said reentrant slots of said second type extending inwardly from said peripheral edge, along the reentrant slot centerlines, generally toward said deflector axis, to a second type length, and the innermost portions of said reentrant slots of said first type extending inwardly toward said deflector axis to be no further outward from said deflector axis than the outermost surface of said apex element.

56. The early suppression fast response pendent-type fire protection sprinkler of claim 55, wherein:

each of said reentrant slots of said first type has a first width transverse to its slot centerline in a region of said peripheral edge and a second width transverse to its slot centerline in a region spaced inwardly, toward said deflector axis, relative to the region of said peripheral edge, the second said width of said first type slots being greater than the first said width of said first type slots, and each of said reentrant slots of said second type has a first width transverse to its slot centerline in a region of said peripheral edge and a second width transverse to its slot centerline in a region spaced inwardly, toward said deflector axis, relative to the region of said peripheral edge, the second said width of said second type slots being greater than the first said width of said second type slots.

57. The early suppression fast response pendent-type fire protection sprinkler of claim 55, wherein said first type length is equal to or greater than said second type length.

58. The early suppression fast response pendent-type fire protection sprinkler of claim 57, wherein said reentrant slot centerlines of said reentrant slots of said first type extend substantially radially outward from said deflector axis.

59. The early suppression fast response pendent-type fire protection sprinkler of claim 58, wherein said reentrant slot centerlines of said reentrant slots of said second type extend substantially radially outward from said deflector axis.

60. The early suppression fast response pendent-type fire protection sprinkler of claim 55, wherein said reentrant slots of said first type comprise at least two pairs of generally opposing reentrant slots.

61. The early suppression fast response pendent-type fire protection sprinkler of claim 55, wherein said reentrant slots of said second type comprise at least two pairs of generally opposing reentrant slots.

62. The early suppression fast response pendent-type fire protection sprinkler of claim 55, wherein said first type length of said reentrant slots of said first type is substantially the same.

63. The early suppression fast response pendent-type fire protection sprinkler of claim 55, wherein said second type length of said reentrant slots of said second type is substantially the same.

64. The early suppression fast response pendent-type fire protection sprinkler of claim 55, wherein said reentrant slots of said first type define reentrant portions having an elongated shape.

65. The early suppression fast response pendent-type fire protection sprinkler of claim 55, wherein said reentrant slots of said second type define reentrant portions having a pear-shape.

66. The early suppression fast response pendent-type fire protection sprinkler of claim 55, wherein a reentrant slot of said second type is located between reentrant slots of said first type.

67. An early suppression fast response fire protection sprinkler suitable for use in accordance with one or more of NFPA 13, NFPA 231 and NFPA 231C, to protect single row rack storage, double row rack storage and multiple row rack storage having a maximum storage height of 25 feet in a storage area having a maximum ceiling height of 30 feet, with no open containers and no solid shelves, said sprinkler having a minimum design flowing pressure of about 15 pounds per square inch, and less than about 40 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

68. An early suppression fast response fire protection sprinkler suitable for use in accordance with one or more of NFPA 13, NFPA 231 and NFPA 231C, to protect single row rack storage, double row rack storage and multiple row rack storage having a maximum storage height of 30 feet in a storage area having a maximum ceiling height of 35 feet, with no open containers and no solid shelves, said sprinkler having a minimum design flowing pressure of about 20 pounds per square inch, and less than about 45 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

69. An early suppression fast response fire protection sprinkler suitable for use in accordance with one or more of NFPA 13, NFPA 231 and NFPA 231C, to protect single row rack storage, double row rack storage and multiple row rack storage having a maximum storage height of 35 feet in a storage area having a maximum ceiling height of 40 feet, with no open containers and no solid shelves, said sprinkler having a minimum design flowing pressure of about 25 pounds per square inch, and less than about 50 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

70. An early suppression fast response fire protection sprinkler suitable for use in accordance with one or more of NFPA 13, NFPA 231 and NFPA 231C, to protect single row rack storage, double row rack storage and multiple row rack storage having a maximum storage height of 40 feet in a storage area having a maximum ceiling height of 45 feet, with no open containers and no solid shelves, said sprinkler having a minimum design flowing pressure of about 40 pounds per square inch, and less than about 65 pounds per square inch, at the most hydraulically remote sprinkler, and further comprising:

a sprinkler body defining an orifice and an outlet for delivering a flow of fluid from a source, and a deflector mounted with a first surface opposed to flow of fluid from the outlet, said deflector defining at least two reentrant slots disposed in opposition about a deflector axis, said reentrant slots extending from said first surface through said deflector, and said reentrant slots extending from slot openings at an outer peripheral edge of said deflector inwardly from said peripheral edge toward said deflector axis.

71. The early suppression fast response fire protection sprinkler of claim 67, 68, 69, or 70, wherein said reentrant slots extend inwardly along reentrant slot centerlines, and each of said reentrant slots has a first width transverse to its reentrant slot centerline in a region of said peripheral edge and a second slot width transverse to its reentrant slot centerline in a region spaced inwardly, toward said deflector axis, relative to the region of said peripheral edge, said second width being greater than said first width.

72. The early suppression fast response fire protection sprinkler of claim 71, further comprising an apex element and wherein said deflector is mounted to said apex element and wherein an innermost portion of each of said reentrant slots extends inwardly toward said deflector axis to be no further outward from said deflector axis that an outermost surface of said apex element.

73. The early suppression fast response fire protection sprinkler of claim 72, wherein said innermost portions of said reentrant slots extend inwardly toward said deflector axis to underlie said apex element, relative to fluid flow direction from said outlet.

74. The early suppression fast response fire protection sprinkler of claim 71, wherein said reentrant slot centerlines extend radially outward from said deflector axis.

75. The early suppression fast response fire protection sprinkler of claim 67, 68, 69, or 70, wherein said sprinkler is suited for installation with said deflector disposed up to 18 inches below a ceiling.

76. The early suppression fast response fire protection sprinkler of claim 67, 68, 69, or 70, wherein said deflector has a thickness measured from said first surface in the direction of fluid flow equal to or greater than about 0.06 inch.

77. The early suppression fast response fire protection sprinkler of claim 67, 68, 69, or 70, wherein said reentrant slots comprise a plurality of reentrant slots, said plurality of reentrant slots comprising at least a first type of reentrant slots and a second type of reentrant slots, reentrant slots of said first type extending from said first surface through said deflector with the slot openings at an outer peripheral edge of said deflector body, each of said reentrant slots of said first type extending inwardly from said peripheral edge, along the reentrant slot centerlines, generally toward said deflector axis, to a first type length, reentrant slots of said second type extending through said deflector from said first surface, with the slot openings at said peripheral edge of said deflector body, each of said reentrant slots of said second type extending inwardly from said peripheral edge, along the reentrant slot centerlines, generally toward said deflector axis, to a second type length, and the innermost portions of said reentrant slots of said first type extending inwardly toward said deflector axis to be no further outward from said deflector axis than the outermost surface of said apex element.

78. The early suppression fast response fire protection sprinkler of claim 77, wherein:

each of said reentrant slots of said first type has a first width transverse to its slot centerline in a region of said peripheral edge and a second width transverse to its slot centerline in a region spaced inwardly, toward said deflector axis, relative to the region of said peripheral edge, the second said width of said first type slots being greater than the first said width of said first type slots, and each of said reentrant slots of said second type has a first width transverse to its slot centerline in a region of said peripheral edge and a second width transverse to its slot centerline in a region spaced inwardly, toward said deflector axis, relative to the region of said peripheral edge, the second said width of said second type slots being greater than the first said width of said second type slots.

79. The early suppression fast response fire protection sprinkler of claim 77, wherein said first type length is equal to or greater than said second type length.

80. The early suppression fast response fire protection sprinkler of claim 79, wherein said reentrant slot centerlines of said reentrant slots of said first type extend substantially radially outward from said deflector axis.

81. The early suppression fast response fire protection sprinkler of claim 80, wherein said reentrant slot centerlines of said reentrant slots of said second type extend substantially radially outward from said deflector axis.

82. The early suppression fast response fire protection sprinkler of claim 77, wherein said reentrant slots of said first type comprise at least two pairs of generally opposing reentrant slots.

83. The early suppression fast response fire protection sprinkler of claim 77, wherein said reentrant slots of said second type comprise at least two pairs of generally opposing reentrant slots.

84. The early suppression fast response fire protection sprinkler of claim 77, wherein said first type length of said reentrant slots of said first type is substantially the same.

85. The early suppression fast response fire protection sprinkler of claim 77, wherein said second type length of said reentrant slots of said second type is substantially the same.

86. The early suppression fast response fire protection sprinkler of claim 77, wherein said reentrant slots of said first type define reentrant portions having an elongated shape.

87. The early suppression fast response fire protection sprinkler of claim 77, wherein said reentrant slots of said second type define reentrant portions having a pear-shape.

88. The early suppression fast response fire protection sprinkler of claim 77, wherein a reentrant slot of said second type is located between reentrant slots of said first type.

89. An early suppression fast response pendent-type fire protection sprinkler suitable for use in accordance with one or more of NFPA 13, NFPA 231 and NFPA 231C, the sprinkler comprising:

a sprinkler body defining an orifice and an outlet that delivers a flow of fluid from a source, the sprinkler body having a K-factor of about 25 and a minimum design flowing pressure of about 15 pounds per square inch, and less than about 40 pounds per square inch, at a most hydraulically remote sprinkler; and a deflector mounted with a first surface opposed to the flow of fluid from the outlet to deflect the flow of fluid to suppress a fire in at least one of a single row rack storage, double row rack storage and multiple row rack storage having a maximum storage height of 25 feet in a storage area having a maximum ceiling height of 30 feet, with no open containers and no solid shelves, the deflector defining at least two grouping of slots disposed about a deflector axis, each of the at least two grouping of slots having at least two slots, each of the slots in each of the at least two grouping of slots extending from the first surface through the deflector, and from slot openings at an outer peripheral edge of the deflector inwardly from the peripheral edge toward the deflector axis, each slot of one grouping of the at least two groupings of slots having a first width generally transverse to a first radial length extending perpendicular to the deflector axis, each slot of another grouping of the at least two groupings of slots having a second width different than the first width and generally transverse to a second radial length extending perpendicular to the deflector axis that is different than the first radial length.

* * * * *

UNITED STATES PATENT AND TRADEMARK OFFICE

CERTIFICATE OF CORRECTION

PATENT NO. : 7,165,624 B1
APPLICATION NO. : 09/292152
DATED : January 23, 2007
INVENTOR(S) : Fischer It is certified that error appears in the above-identified patent and that said Letters Patent is hereby corrected as shown below:

On the title page under item (57), change "89 claims," to -- 121 claims, --

Column 25, line 22, that portion of claim 89 reading "of about 15" should read --ranging from 15--;
line 23, that portion of claim 89 reading ", and less than about 40" should read --to 40--.

Column 26, line 1, that portion of claim 89 reading "mounted with" should read --including--; line 24, insert the following claims, claim 90 to claim 121:

--90. The early suppression fast response pendent-type fire protection sprinkler of claim 89, 108, 109, or 111, wherein the at least two slots of each of the at least two grouping of slots define at least two reentrant slots.

91. The early suppression fast response pendent-type fire protection sprinkler of claim 90, wherein each of the at least two reentrant slots extend inwardly along reentrant slot centerlines, and each of the at least two reentrant slots has a first width transverse to its reentrant slot centerline in a region of the peripheral edge and a second slot width transverse to its reentrant slot centerline in a region spaced inwardly, toward the deflector axis, relative to the region of the peripheral edge, the second width being greater than the first width.

92. The early suppression fast response pendent-type fire protection sprinkler of claim 89, 108, 109, or 111, wherein the outlet defines an outlet axis and the sprinkler further comprises an apex element defining a curve in the direction of the outlet axis.

93. The early suppression fast response pendent-type fire protection sprinkler of claim 89, 108, 109, or 111, wherein the sprinkler is suited for installation with the deflector disposed up to 18 inches below a ceiling.

94. The early suppression fast response pendent-type fire protection sprinkler of claim 89, 108, 109, or 111, wherein the deflector has a thickness measured from the first surface in the direction of fluid flow equal to or greater than about 0.06 inch.

95. The early suppression fast response pendent-type fire protection sprinkler of claim 89, 108, 109, or 111, wherein the outlet defines a longitudinal axis along the sprinkler body, the sprinkler further comprising an apex element aligned with the outlet axis, the deflector mounted to the apex element.

96. The early suppression fast response pendent-type fire protection sprinkler of claim 95, the body further comprising a pair of arms mounted about the body, the arms joining at the apex element.

97. The early suppression fast response pendent-type fire protection sprinkler of claim 95, further comprising a plate assembly to close the outlet and a thermally responsive element disposed between the outlet and the apex to support the plate.

It is certified that error appears in the above-identified patent and that said Letters Patent is hereby corrected as shown below:

98. The early suppression fast response pendent-type fire protection sprinkler of claim 97, wherein the thermally responsive element comprises a fusible solder alloy.

99. The early suppression fast response pendent-type fire protection sprinkler of claim 97, wherein the thermally responsive element has a temperature rating between 165°F (74 °C) and 214 °F (101 °C).

100. The early suppression fast response pendent-type fire protection sprinkler of claim 97, further comprising a strut and a lever to transfer a force from the thermally responsive element to the plate assembly, the sprinkler further comprising a threaded fastener engaged with the apex to coaxially support the lever.

101. The early suppression fast response pendent-type fire protection sprinkler of claim 89, 108, 109, or 111, wherein the K-factor of the body is 25.2.

102. The early suppression fast response pendent-type fire protection sprinkler of claim 89, 108, 109, or 111, wherein the first surface opposes the flow of fluid to deflect the flow of fluid to suppress a fire in the at least one of a single rack storage, double row rack storage, and multiple row rack storage, the at least one storage further includes portable storage.

103. The early suppression fast response pendent-type fire protection sprinkler of claim 102, wherein at least one storage includes at least one of palletized and solid pile storage.

104. The early suppression fast response pendent-type fire protection sprinkler of claim 103, wherein the at least one storage includes encapsulated or non-encapsulated materials.

105. The early suppression fast response pendent-type fire protection sprinkler of claim 103, wherein the at least one storage includes cartoned unexpanded plastics.

106. The early suppression fast response pendent-type fire protection sprinkler of claim 103, wherein the at least one storage includes at least one of Class I, Class II, Class III and Class IV commodities.

107. The early suppression fast response pendent-type fire protection sprinkler of claim 103, wherein the at least one storage includes at least one of roll paper and rubber tires.

108. An early suppression fast response pendent-type fire protection sprinkler suitable for use in accordance with one or more of NFPA 13, NFPA 231 and NFPA 231C, the sprinkler comprising:

a sprinkler body defining an orifice and an outlet that delivers a flow of fluid from a source, the sprinkler body having a K-factor of about 25 and a minimum design flowing pressure ranging from 20 pounds per square inch to 45 pounds per square inch, at a most hydraulically remote sprinkler; and It is certified that error appears in the above-identified patent and that said Letters Patent is hereby corrected as shown below:

a deflector including a first surface opposed to the flow of fluid from the outlet to deflect the flow of fluid to suppress a fire in at least one of a single row rack storage, double row rack storage and multiple row rack storage having a maximum storage height of 30 feet in a storage area having a maximum ceiling height of 35 feet, with no open containers and no solid shelves, the deflector defining at least two grouping of slots disposed about a deflector axis, each of the at least two grouping of slots having at least two slots, each of the slots in each of the at least two grouping of slots extending from the first surface through the deflector, and from slot openings at an outer peripheral edge of the deflector inwardly from the peripheral edge toward the deflector axis, each slot of one grouping of the at least two groupings of slots having a first width generally transverse to a first radial length extending perpendicular to the deflector axis, each slot of another grouping of the at least two groupings of slots having a second width different than the first width and generally transverse to a second radial length extending perpendicular to the deflector axis that is different than the first radial length.

109. An early suppression fast response pendent-type fire protection sprinkler suitable for use in accordance with one or more of NFPA 13, NFPA 231 and NFPA 231C. the sprinkler comprising:

a sprinkler body defining an orifice and an outlet that delivers a flow of fluid from a source, the sprinkler body having a K-factor of about 25 and a minimum design flowing pressure ranging from 25 pounds per square inch to 50 pounds per square inch, at a most hydraulically remote sprinkler; and a deflector including a first surface opposed to the flow of fluid from the outlet to deflect the flow of fluid to suppress a fire in at least one of a single row rack storage, double row rack storage and multiple row rack storage having a maximum storage height of 35 feet in a storage area having a maximum ceiling height of 40 feet, with no open containers and no solid shelves, the deflector defining at least two grouping of slots disposed about a deflector axis, each of the at least two grouping of slots having at least two slots, each of the slots in each of the at least two grouping of slots extending from the first surface through the deflector, and from slot openings at an outer peripheral edge of the deflector inwardly from the peripheral edge toward the deflector axis, each slot of one grouping of the at least two groupings of slots having a first width generally transverse to a first radial length extending perpendicular to the deflector axis, each slot of another grouping of the at least two groupings of slots having a second width different than the first width and generally transverse to a second radial length extending perpendicular to the deflector axis that is different than the first radial length.

110. The early suppression fast response pendent-type fire protection sprinkler of claim 109, wherein the minimum design flowing pressure is 40 pounds per It is certified that error appears in the above-identified patent and that said Letters Patent is hereby corrected as shown below:

square inch.

111. An early suppression fast response pendent-type fire protection sprinkler suitable for use in accordance with one or more of NFPA 13, NFPA 231 and NFPA 231C, the sprinkler comprising:

a sprinkler body defining an orifice and an outlet that delivers a flow of fluid from a source, the sprinkler body having a K-factor of about 25 and a minimum design flowing pressure ranging from 40 pounds per square inch to 65 pounds per square inch, at a most hydraulically remote sprinkler; and a deflector including a first surface opposed to the flow of fluid from the outlet to deflect the flow of fluid to suppress a fire in at least one of a single row rack storage, double row rack storage and multiple row rack storage having a maximum storage height of 40 feet in a storage area having a maximum ceiling height of 45 feet, with no open containers and no solid shelves, the deflector defining at least two grouping of slots disposed about a deflector axis, each of the at least two grouping of slots having at least two slots, each of the slots in each of the at least two grouping of slots extending from the first surface through the deflector, and from slot openings at an outer peripheral edge of the deflector inwardly from the peripheral edge toward the deflector axis, each slot of one grouping of the at least two groupings of slots having a first width generally transverse to a first radial length extending perpendicular to the deflector axis, each slot of another grouping of the at least two groupings of slots having a second width different than the first width and generally transverse to a second radial length extending perpendicular to the deflector axis that is different than the first radial length.

112. The early suppression fast response pendent-type fire protection sprinkler of claim 111, wherein the maximum storage height is about 40 feet, the maximum ceiling height is about 45 feet, and the minimum design flowing pressure is 60 pounds per square inch.

113. An early suppression fast response pendent-type fire protection sprinkler suitable for use in accordance with one or more of NFPA 13, NFPA 231 and NFPA 231C, the sprinkler comprising:

a sprinkler body defining an orifice and an outlet along a longitudinal axis that delivers a flow of fluid from a source, the sprinkler body having a K-factor of about 25 and a base having a pair of arms diametrically mounted about the base;

a plate assembly axially aligned and adjacent the outlet and a thermally responsive element supporting the plate assembly to close the outlet;

an apex element disposed along the longitudinal axis, the pair of arms being joined at the apex element, the apex element defining a curve in the direction of the longitudinal axis;

It is certified that error appears in the above-identified patent and that said Letters Patent is hereby corrected as shown below:

a deflector affixed to the apex element, the deflector including a first surface opposed to the flow of fluid from the outlet, the deflector defining at least two grouping of slots disposed about a deflector axis, each of the at least two grouping of slots having at least two slots, each of the slots in each of the at least two grouping of slots extending from the first surface through the deflector, and from slot openings at an outer peripheral edge of the deflector inwardly from the peripheral edge toward the deflector axis, each slot of one grouping of the at least two groupings of slots having a first width generally transverse to a first radial length extending perpendicular to the deflector axis, each slot of another grouping of the at least two groupings of slots having a second width different than the first width and generally transverse to a second radial length extending perpendicular to the deflector axis that is different than the first radial length, wherein the first surface being configured to deflect the flow of fluid to suppress a fire in at least one or a single row rack storage, double row rack storage, multiple row rack storage and portable row rack storage having a maximum storage height in a storage area having a maximum ceiling height, with no open containers and no solid shelves, the body having a minimum design flowing pressure measured in pounds per square inch at a most hydraulically remote sprinkler for the given maximum storage height and the maximum ceiling height, wherein when the maximum storage height is about 35 feet and the maximum ceiling height is about 40 feet, the minimum design flowing pressure ranging from 25 pounds per square inch to 50 pounds per square inch, and wherein when the maximum storage height is about 40 feet and the maximum ceiling height is about 45 feet, the minimum design flowing pressure ranging from 40 pounds per square inch to 65 pounds per square inch.

114. The early suppression fast response pendent-type fire protection sprinkler of claim 113, wherein the at least two slots of each of the at least two grouping of slots define at least two reentrant slots.

115. The early suppression fast response pendent-type fire protection sprinkler of claim 114, wherein each of the at least two reentrant slots extend inwardly along reentrant slot centerlines, and each of the at least two reentrant slots has a first width transverse to its reentrant slot centerline in a region of the peripheral edge and a second slot width transverse to its reentrant slot centerline in a region spaced inwardly, toward the deflector axis, relative to the region of the peripheral edge, the second width being greater than the first width.

116. The early suppression fast response pendent-type fire protection sprinkler of claim 113, wherein when the maximum storage height is about 35 feet and the maximum ceiling height is about 40 feet, the minimum design flowing pressure being 40 pounds per square inch.

UNITED STATES PATENT AND TRADEMARK OFFICE

CERTIFICATE OF CORRECTION

PATENT NO. : 7,165,624 B1
APPLICATION NO. : 09/292152
DATED : January 23, 2007
INVENTOR(S) : Fischer It is certified that error appears in the above-identified patent and that said Letters Patent is hereby corrected as shown below:

117. The early suppression fast response pendent-type fire protection sprinkler of claim 113, wherein when the maximum storage height is about 40 feet and the maximum ceiling height is about 45 feet, the minimum design flowing pressure being 60 pounds per square inch.

118. The early suppression fast response pendent-type fire protection sprinkler of claim 113. wherein the sprinkler is suited for installation with the deflector disposed up to 18 inches below a ceiling.

119. The early suppression fast response pendent-type fire protection sprinkler of claim 113, wherein the deflector has a thickness measured from the first surface in the direction of fluid flow equal to or greater than about 0.06 inch.

120. The early suppression fast response pendent-type fire protection sprinkler of claim 113, wherein the K-factor of the sprinkler body is 25.2.

121. The early suppression fast response pendent-type fire protection sprinkler of claim 113, wherein the apex element includes a central bore having a threaded fastener disposed therein, the sprinkler further comprising a lever and strut engaged with the thermally responsive element to support the thermally responsive element, the threaded fastener further engaging the lever and strut along the longitudinal axis.--

Signed and Sealed this

Twentieth Day of March, 2007

JON W. DUDAS
*Director of the United States Patent and Trademark Office*